US006537091B2

(12) United States Patent
Hirai et al.

(10) Patent No.: US 6,537,091 B2
(45) Date of Patent: Mar. 25, 2003

(54) ARC DISCHARGE SUPPRESSIVE TERMINAL, METHOD FOR PRODUCING SUCH TERMINAL, AND ARC DISCHARGE SUPPRESSIVE CONNECTOR

(75) Inventors: Hiroki Hirai, Nagoya (JP); Koji Ota, Nagoya (JP); Yoshitsugu Tsuji, Nagoya (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/991,710

(22) Filed: Nov. 26, 2001

(65) Prior Publication Data

US 2002/0064986 A1 May 30, 2002

(30) Foreign Application Priority Data

| | | |
|---|---|---|
| Nov. 28, 2000 | (JP) | 2000-361799 |
| Jul. 26, 2001 | (JP) | 2001-225614 |
| Oct. 5, 2001 | (JP) | 2001-310027 |

(51) Int. Cl.[7] ..... H01R 13/53
(52) U.S. Cl. ..... 439/181; 439/693; 439/886
(58) Field of Search ..... 439/181, 693, 439/886; 29/874, 883

(56) References Cited

U.S. PATENT DOCUMENTS

| | | | | |
|---|---|---|---|---|
| 4,012,103 A | * | 3/1977 | Lunquist | 439/181 |
| 4,747,783 A | * | 5/1988 | Bellamy et al. | 439/59 |
| 5,664,326 A | * | 9/1997 | Ohsumi | 29/874 |

FOREIGN PATENT DOCUMENTS

| | | |
|---|---|---|
| JP | A 2001-206521 | 9/2001 |
| JP | A 2001-250622 | 9/2001 |
| JP | A 2001-250646 | 9/2001 |
| JP | A 2001-351726 | 12/2001 |

* cited by examiner

*Primary Examiner*—P. Austin Bradley
*Assistant Examiner*—Ross Gushi
(74) *Attorney, Agent, or Firm*—Oliff & Berridge, PLC

(57) ABSTRACT

Disclosed is a terminal constructed in such a manner that at least an outer portion of the terminal including a region corresponding to a last-contact part of the terminal with a counterpart terminal when the terminal is disengaged from the counterpart terminal is formed of an insulating member. A conductive layer is formed on the surface of the insulating member to be electrically connected to a conductive part of the terminal. The terminal is constructed in such a manner that the conductive layer is detached from the counterpart terminal at a final stage of disengagement of the terminals. With this arrangement, arc discharge at the disengagement of the terminals is suppressed.

16 Claims, 19 Drawing Sheets

ARC DISCHARGE SUPPRESSIVE TERMINAL, METHOD FOR PRODUCING SUCH TERMINAL, AND ARC DISCHARGE SUPPRESSIVE CONNECTOR

BACKGROUND OF THE INVENTION

1. Field of the Invention

This invention relates to a connector for use in a wire harness in an automotive vehicle, and a terminal for use in such a connector.

2. Description of the Related Art

It is a general practice to detach connectors used in an automotive vehicle or the like therefrom every several months or every several years for maintenance and checkup thereof. It is highly likely that arc discharge may occur at a detachment of terminals of the connectors when the terminal of one of the connectors is about to be withdrawn from the corresponding terminal of the opposite one of the connectors. Particularly, it is conceivable that a considerably large amount of arc is discharged in view of the recent development of technology in which a higher source voltage is supplied for a battery of an automotive vehicle. Thus, it is highly likely that the terminals may be damaged due to occurrence of such large amount of arc discharge.

Generally, a male terminal has a bar-like or a plate-like shape with a lead end thereof tapered in order to facilitate insertion into a female terminal. Every time the male terminal is disengaged from and engaged into the female terminal, arc discharge occurs. The repeated engagement and disengagement causes to melt the tapered lead end of the male terminal due to repeated arc discharges. The melted part of the male terminal is cooled to solidify, accompanied with shifting of the melted part slightly toward a base end thereof. As a result, the tapered lead end of the male terminal disappears accompanied by increase of a diameter thereof. In other words, the terminal is likely to be deformed due to melting by repeated arc discharges, which may result in contact failure with the female terminal or, in a worse case, difficulty or inability of insertion into the female terminal.

SUMMARY OF THE INVENTION

It is an object of the invention to provide a terminal, terminal producing method, and connector which are free from the problems residing in the prior art.

According to an aspect of the invention, a terminal has a region having a last contact part with a counterpart terminal when the terminal is disengaged from the counterpart terminal. The region is formed with an insulating section. A conductive section is formed on a surface of the insulating section. The conductive section is electrically connectable to the counterpart terminal.

With this arrangement, the terminals are electrically connectable until the counterpart terminal is detached from the conductive section of the terminal, and arc discharge can be remarkably suppressed by the insulating section. Thus, deformation of the terminal can be effectively suppressed.

These and other objects, features and advantages of the present invention will become more apparent upon a reading of the following detailed description and accompanying drawing.

DETAILED DESCRIPTION OF THE PREFERRED EMBODIMENTS OF THE INVENTION

A terminal and a connector embodying the invention are described in detail with reference to the accompanying drawings. Described is first a terminal embodying the invention.

Figure 1A:
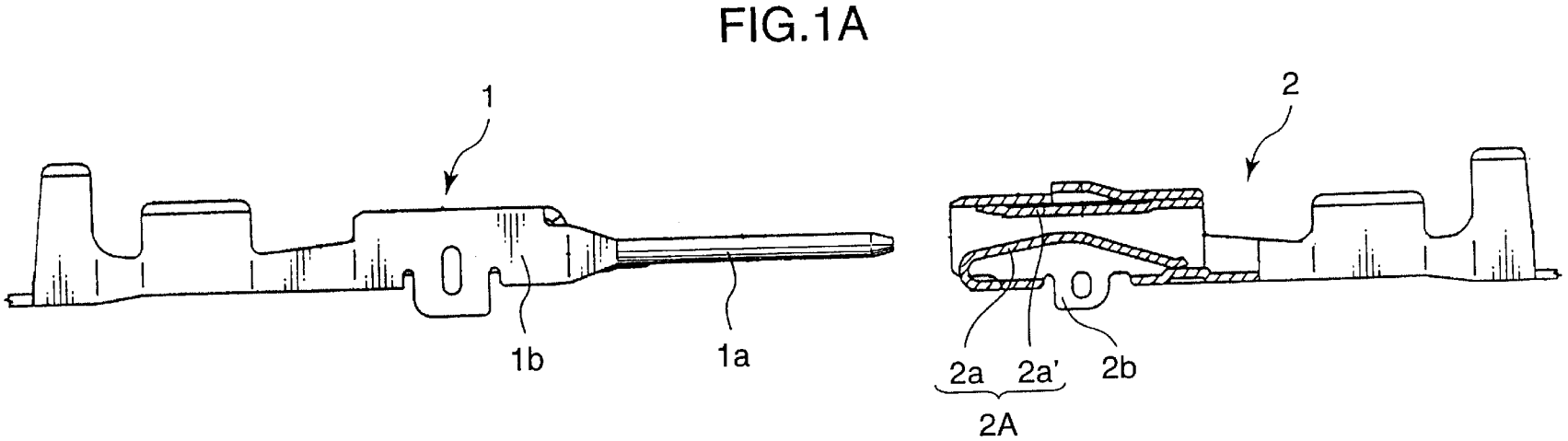
FIGS. 1A and 1B are side views schematically showing a male terminal and a female terminal in accordance with a first embodiment of the present invention.
Figure 1B:
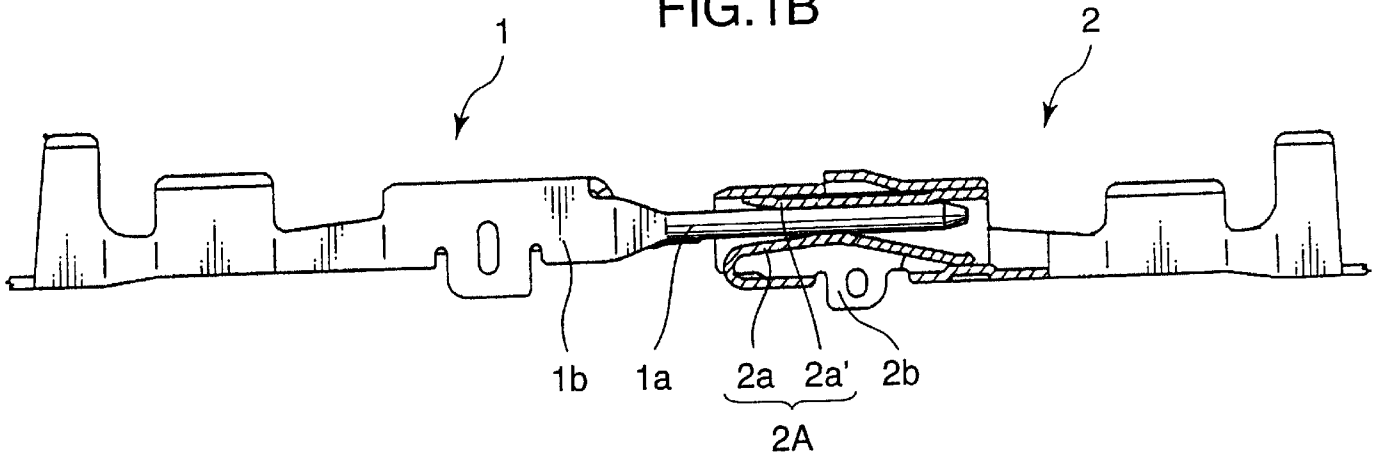
Figure 2:
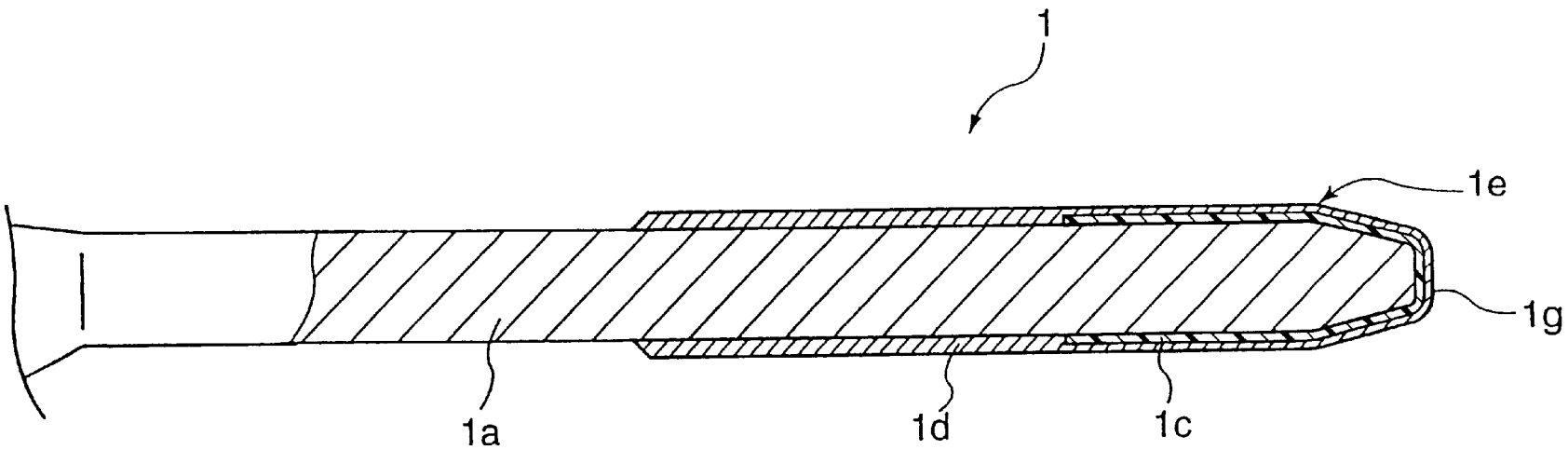
FIG. 2 is a partially enlarged sectional view of the male terminal shown in FIGS. 1A and 1B.
Figure 3:
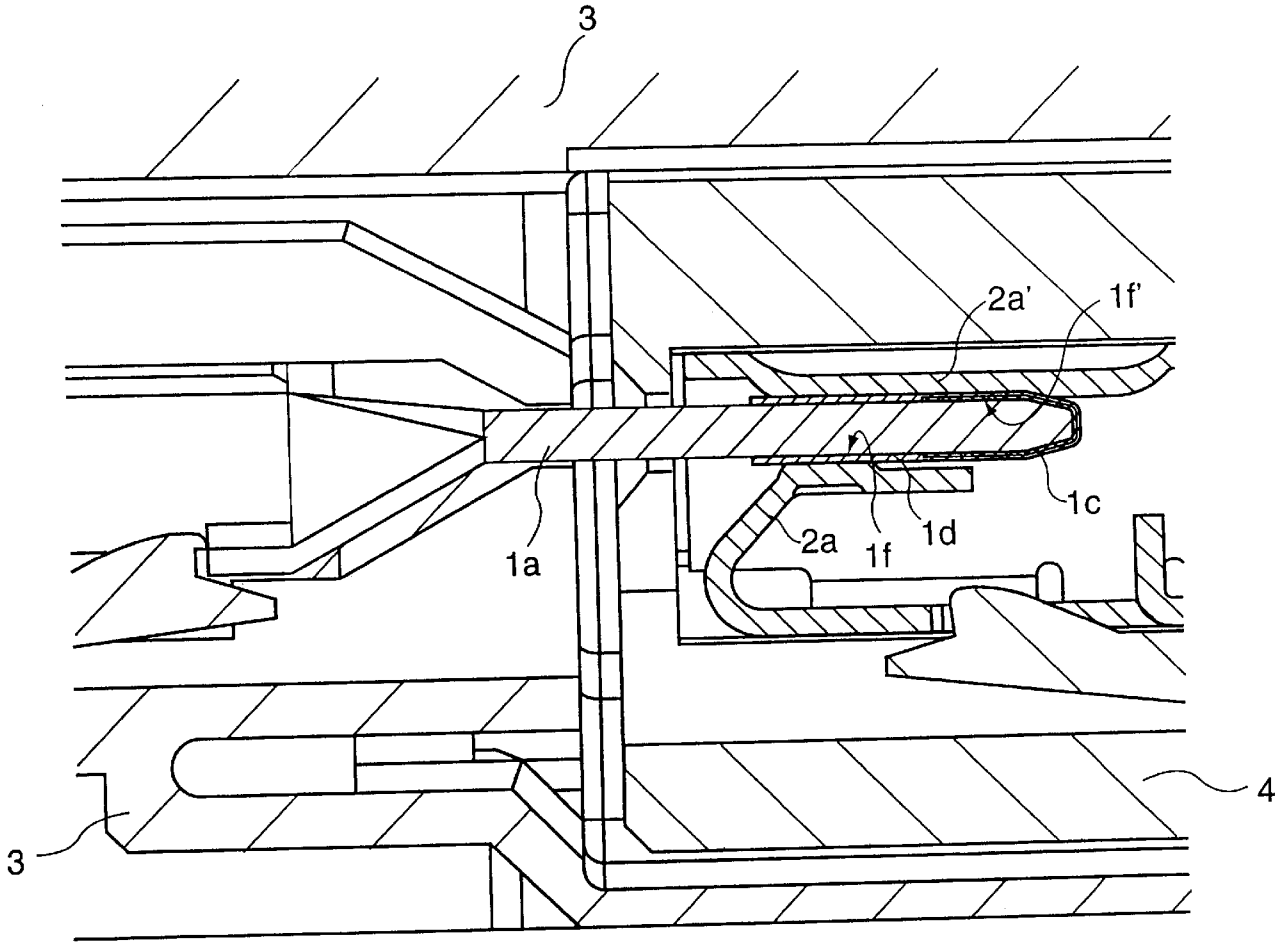
FIG. 3 is a partially enlarged sectional view showing a state that the male terminal and the female terminal in FIGS. 1A and 1B are engaged.
Figure 4:
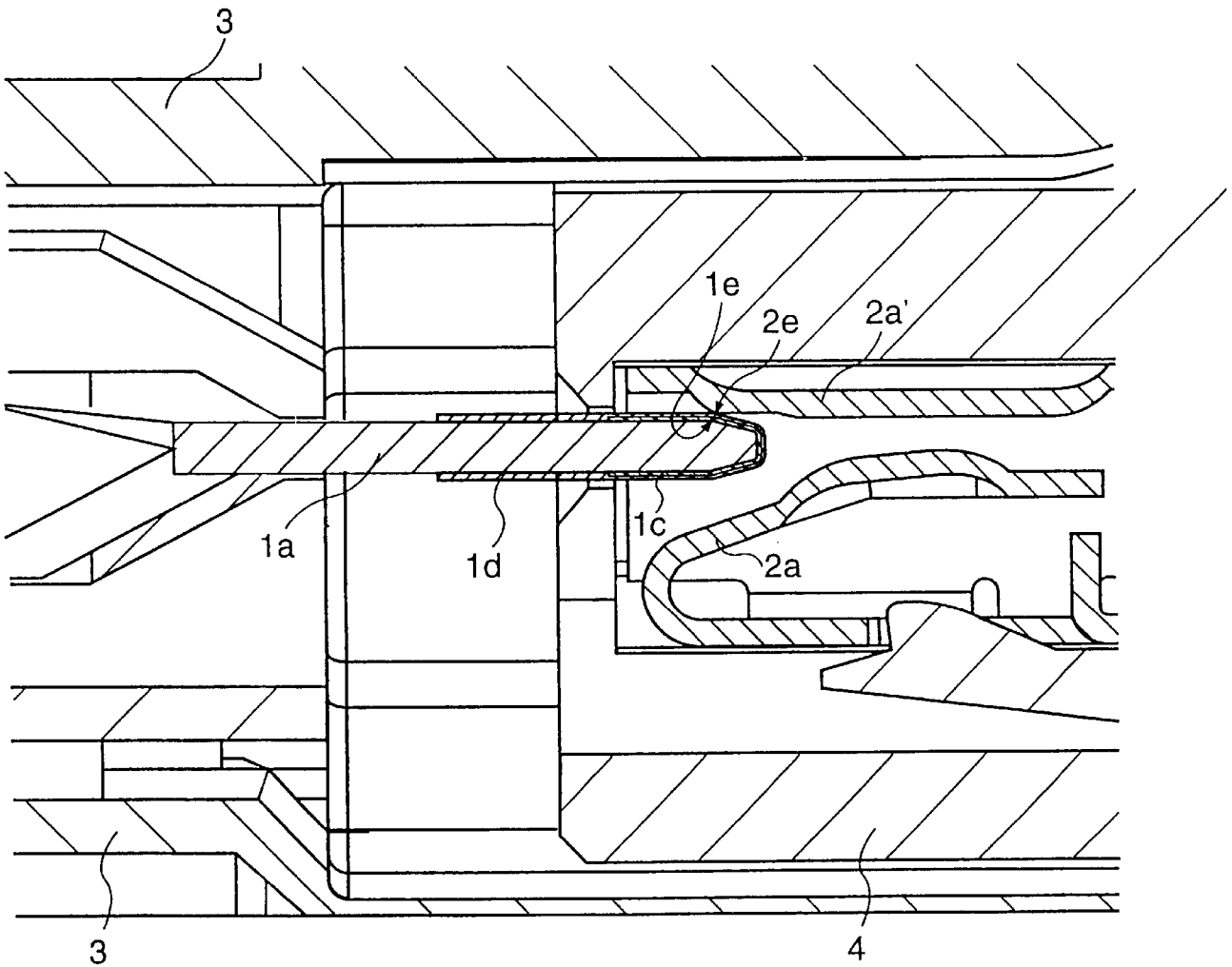
FIG. 4 is a partially enlarged sectional view showing a state that the male terminal and the female terminal in FIGS. 1A and 1B are about to be disengaged.

A terminal in accordance with a first embodiment of the invention is described with reference to FIGS. 1A to 4. FIGS. 1A and 1B are side views each schematically showing an example of the inventive terminal. FIG. 2 is a partially enlarged sectional view of a male terminal in accordance with the first embodiment of the invention. FIG. 3 is a partially enlarged sectional view showing a state that the male terminal is engaged with a female terminal. FIG. 4 is an enlarged sectional view showing a state that the male terminal is about to be disengaged from the female terminal.

As shown in FIG. 1A, the male terminal 1 includes a box-like part 1*b* constituting a main body of the terminal, and a male electric contact part (male tab) 1*a* which projects axially forwardly from the box-like part 1*b*. The entirety of the terminal main body is made of a material having a high conductivity such as copper metal. The male terminal 1 and a housing 3 made of resin which is adapted to accommodate the male terminal 1 therein constitutes a male connector.

A female terminal 2 includes a box-like part 2*b*. A contact spring 2*a* and a second contact piece 2*a*' are provided in the box-like part 2*b* in such a manner that the second contact piece 2*a*' opposes the contact spring 2*a* to sandwich the male tab 1*b* therebetween in an engagement of the male terminal 1 and the female terminal 2. Similar to the male terminal 1, the female terminal 2 is housed in a housing 4 made of resin. The female terminal 2 and the housing 4 constitutes a female connector.

As shown in FIGS. 1B and 3, engaging the terminals 1 and 2 enables to render the male tab 1*a* into contact with a female electric contact part 2A including the contact spring 2*a* and the second contact piece 2*a*', thereby allowing the terminals 1 and 2 to be electrically connectable.

When the male terminal 1 thus engaged with the female terminal 2 is about to be withdrawn therefrom, arc is likely to be discharged at and/or around a contact portion between the male tab 1*a* and the female contact part 2A. For instance, as shown in FIG. 4, when the male terminal 1 is about to be withdrawn from the female terminal 2 axially rearwardly, the male tab 1*a* is first detached from the contact spring 2*a*, and then is detached from the second contact piece 2*a*'. At a final stage of disengagement, namely, at a stage of detaching the male tab 1*a* from the second contact piece 2*a*' in FIG. 4, arc is discharged at and/or around a contact portion between the male terminal 1 and the female terminal 2, which may likely to damage the terminals 1 and 2.

According to the invention, the male terminal 1 is so constructed that an insulating layer 1*c* (see FIGS. 2 and 4) is formed at an outer region of the male terminal 1 including a distal end part 1*e* (hereinafter, also referred to as "final-contact part 1*e*") which corresponds to a part of the male terminal 1 in contact with the female terminal 2 at a final stage of disengagement. Further, the male terminal 1 is so constructed that a conductive layer 1*d* covers the entirety of the insulating layer 1*c*. The conductive layer 1*d* is electrically connected to a primary part (conductive part) of the male terminal 1. Covering the final-contact part 1*e* with the insulating layer 1*c* and the conductive layer 1*d* as mentioned above enables to keep the male terminal 1 electrically connectable with the female terminal 2 by way of the conductive layer 1*d* until the male terminal 1 is completely disengaged from the female terminal 2. Also, even in the case where arc is discharged at the disengagement of the male terminal 1 from the female terminal 2, the insulating layer 1*c* formed on the inner side of the conductive layer 1*d* effectively lowers the amount of discharged arc to thereby securely suppress deformation of the male terminal 1 and the female terminal 2.

The present invention is effective for the following reasons in the aspect of suppressing arc discharge and deformation of terminals.

[First reason]

In the conventional arrangement in which the male terminal is not provided with an insulating layer and a conductive layer, once arc discharge initiates at the time of disengagement of the terminals, metallic vapor is successively generated from the tab part of the terminal. As a result, arc discharge is promoted. On the other hand, in the inventive arrangement, since the male terminal 1 (male tab 1*a* in FIGS. 1A to 4) is coated with the insulating layer, generation of metallic vapor from the primary part of the tab is blocked by the insulating layer. Consequently, even if metallic vapor is generated, a supply source of such metallic vapor is restricted to the conductive layer which has a smaller thickness compared to the primary part of the tab. Accordingly, emission of metallic vapor is eventually blocked by the insulating layer, thereby reducing the amount of discharged arc.

[Second reason]

In the conventional arrangement where the male terminal is not provided with the insulating layer and the conductive layer, once arc is discharged, the tab part of the male terminal is likely to be deformed by discharged arc. On the other hand, in the inventive arrangement where the male terminal is coated with the insulating layer and the conductive layer, even if arc is discharged, damage is restricted to the outer surface of the conductive layer. Since it is less likely that the primary part of the tab may be deformed because the primary part of the tab is located on the inner side of the insulating layer, a desirable engagement of the terminals is maintained.

The insulating layer 1*c* may preferably be formed at least at the final-contact part 1*e*. A site for forming the insulating layer 1*c* on the final-contact part 1*e* of the male terminal 1 is not limited to the one as illustrated. However, it is preferable not to form an insulating layer on a certain part of the male terminal 1 which is rendered into contact with the female terminal 2 during an engagement. For example, in FIG. 3, the male tab 1*a* is in contact with the contact spring 2*a* and the second contact piece 2*a*' in a securely engaged state of the male terminal 1 and the female terminal 2. Parts of the male terminal 1*a* which are rendered into contact with the contact spring 2*a* and the second contact piece 2*a*' are respectively referred to as "contact part 1*f*" and "contact part 1*f*'". In this state, the insulating layer 1*c* is not formed on the contact parts 1*f* and 1*f*' (entire region of the contact part 1*f* and a base region of the contact part 1*f*' in FIG. 3). Thus, non-formation of the insulating layer 1*c* on the certain part of the male terminal 1 which is rendered into contact with the female terminal 2 in an engagement enables to render the male terminal 1 in direct contact with the female terminal 2 or in indirect contact therewith via the conductive layer 1*d*. Thereby, there is no likelihood of lowering conductivity of the connectors in an engagement of the terminals.

The insulating layer 1*c* is generally formed on a certain region including the final-contact part 1*e* of the male terminal 1. It is preferable to form the insulating layer 1*c* on the following region:

(a) covering an axially most lead end position of the final-contact part 1*e*+1 mm;

(b) more preferably, covering an axially most lead end position of the final-contact part 1*e*+3 mm;

(c) furthermore preferably, covering an axially most lead end position of the final-contact part 1*e*+5 mm.

Forming the insulating layer 1*c* on the above region enables to securely prevent arc from being discharged around the terminal beyond the insulating layer 1*c*.

Generally, in the case of the male terminal 1, a distal end 1*g* or its vicinity (in FIG. 2, the part 1*e*) constitutes the final-contact part. In view of this, in the case where the insulating layer is formed on the male tab 1*a*, it is feasible to form the insulating layer 1*c* having an axial length of 1 mm or longer, preferably 3 mm or longer from the distal end 1*g*.

The material of forming the insulating layer 1*c* is not limited, as far as the material is effective to suppress arc discharge as low as possible. The insulating layer 1*c* includes layers processed with metallic deposition such as $Al_2O_3$(alumite)-layer, $SiO_2$-layer, $Si_3N_4$-layer, $TiO_2$-layer, metallic insulating layers such as layers applied with black color coating (CuO-layer), layers processed with chromate, and resinous insulating layers made of insulating resins.

The metallic layer is not necessarily formed by vapor deposition, and may be formable by metal plating, adhering a thin metallic film on the terminal, or its equivalent.

The resinous insulating layer may be formed by applying a coating agent (paint coating, enamel coating, varnished coating, etc.) in which an insulating resin is dissolved in a solvent onto the terminal according to various coating techniques (including spray coating and dipping). A baking process may be added when need arises to do so. Alternatively, the insulating resin may be applied in powdery state, or an insulating film may be adhered on the terminal.

Generally, the thickness of the insulating layer 1*c* ranges from 0.5 to 500$\mu$m, preferably from 5 to 50 $\mu$m.

Generally, the insulating layer 1*c* has an electric resistance of $1\times10^{16}$ Ω or greater. Providing the insulating layer with an electric resistance larger than that of a metal (silver metal) constituting a tab part of the terminal enables to reduce arc discharge. In other words, the insulating layer may be electrically conductive to a certain extent as far as arc discharge is suppressed. In view of this, the electric resistance of the insulating layer may be, for example, 1 Ω or larger, preferably 20 Ω or larger.

A site for forming the conductive layer 1*d* is not specifically limited, as far as the conductive layer 1*d* covers the insulating layer 1*c*. Generally, it is preferable to form the conductive layer 1*d* over a region covering at least 0.1 mm in axial length (preferably, at least 1 mm in axial length) from an outermost (most upstream) end position in the terminal insertion direction in order to securely render the conductive layer 1*d* electrically connectable with the terminal 1.

The entirety of the male terminal 1 (or male tab la) may be covered with the conductive layer 1*d*. In the case where the entirety of the male terminal 1 (or male tab 1*a*) is not covered with the conductive layer 1*d*, the conductive layer 1*d* may preferably be formed over a region covering 3 mm in axial length at longest from the most upstream end position of the insulating layer 1*c* in the terminal insertion direction.

The conductive layer may be a layer plated with a conductive metal such as Sn, Ni, Al, Ag, and Au, or a conductive polymer layer such as a polyaniline layer which is doped with an alkali metal. In the case where a metallic layer is formed by plating a metal, there rises a case that the resultant metallic layer may have a smaller strength at a portion where electroless plating has been performed. In view of such drawback, in the case where electroless plating is performed, it may be preferable to plate the outermost layer by the other plating method (electrolytic plating, hot dipping or the like).

The conductive layer may preferably be a thin film (for example, 500 $\mu$m or less in thickness, preferably 100 $\mu$m or less, more preferably 35 $\mu$m or less). The smaller the thickness of the conductive layer is, the more the amount of metallic vapor resultantly emitted from arc discharge can be lowered. Thus, the amount of arc discharge itself can be reduced. The conductive layer generally has a thickness of 0.01 $\mu$m or greater, preferably, 0.1 $\mu$m or greater.

The combination of the insulating layer 1*c* and the conductive layer 1*d* is not limited to the aforementioned example. Not only the arrangement in which the conductive layer 1*d* directly covers the insulating layer 1*c* but also the arrangement in which the conductive layer 1*d* indirectly covers the insulating layer 1*c* is applicable. In the case of indirect covering, an intermediate layer is provided between the insulating layer 1*c* and the conductive layer 1*d* to indirectly cover the insulating layer 1*c* with the conductive layer 1*d*. Hereinafter, exemplified combinations are described.

[Example of Combination of Direct Covering]

insulating layer 1*c*: a resinous insulating layer (such as enamel layer), and conductive layer 1*d*: a conductive resinous layer

[Example of Combination of Indirect Covering Provided with an Intermediate Layer]

insulating layer 1*c*: a layer processed with black color coating, a layer processed by chromate, or a resinous insulating layer (such as enamel layer), conductive layer 1*d*: a layer plated with a conductive metal (such as a layer formed by electrolytic plating), and intermediate layer: a layer formed by electroless plating (electroless plating with Ni, Sn, Al, etc.).

An insulating layer and a conductive layer may be formed on the female terminal, or alternatively, formed on both of the male terminal and the female terminal. For instance, in the case where a conductive layer is formed on the female terminal in the drawings of FIGS. 1A to 4, the second contact piece 2*a*' may correspond to a final-contact part 2*e* of the female terminal 2 which corresponds to the final-contact part 1*e* of the male terminal 1. In such a case, an insulating layer and a conductive layer may be formed on a region including the final-contact part 2*e*. There is a case that the contact spring 2*a* may correspond to the final-contact part 1*e*. In such a case, the contact spring 2*a* may be formed with an insulating layer and a conductive layer.

According to the invention, since the final-contact part is covered with the insulating layer, arc discharge, even if occurs, immediately disappears. Thus, damage due to arc discharge is restricted within a region where the conductive layer is formed, and a terminal is prevented from damage. Even if part of the conductive layer is damaged or broken, which may result in exposure of the insulating layer, the terminal is usable for a certain number of times (e.g., 3 to 200 times) until the conductive layer is almost completely peeled off because the remaining part of the conductive layer makes the terminal electrically conductive while blocking arc discharge thereat. When the thus constructed terminal is used, for example, in a connector of a wire harness in an automotive vehicle, it is less likely that the conductive layer is completely peeled off at a detachment of the terminals for maintenance and repair of an automotive vehicle even if a high voltage is applied to the wire harness.

The male terminal 1 may be integrally formed of a single material. In such a case, however, a masking process is required to partially provide the insulating layer 1*c* on a restricted region such as a lead end part of the male tab 1*a*, as shown in FIG. 1. Further, it is preferable to etch the surface of the insulating layer 1*c* to form a desirable conductive layer (plated layer) 1*d*on the insulating layer 1*c*. However, in the case where the insulating layer 1*c* is provided on the integrally formed one-piece male terminal 1, it is extremely difficult to etch the surface of the insulating layer 1*c* without corroding the main part of the male terminal 1.

Figure 5:
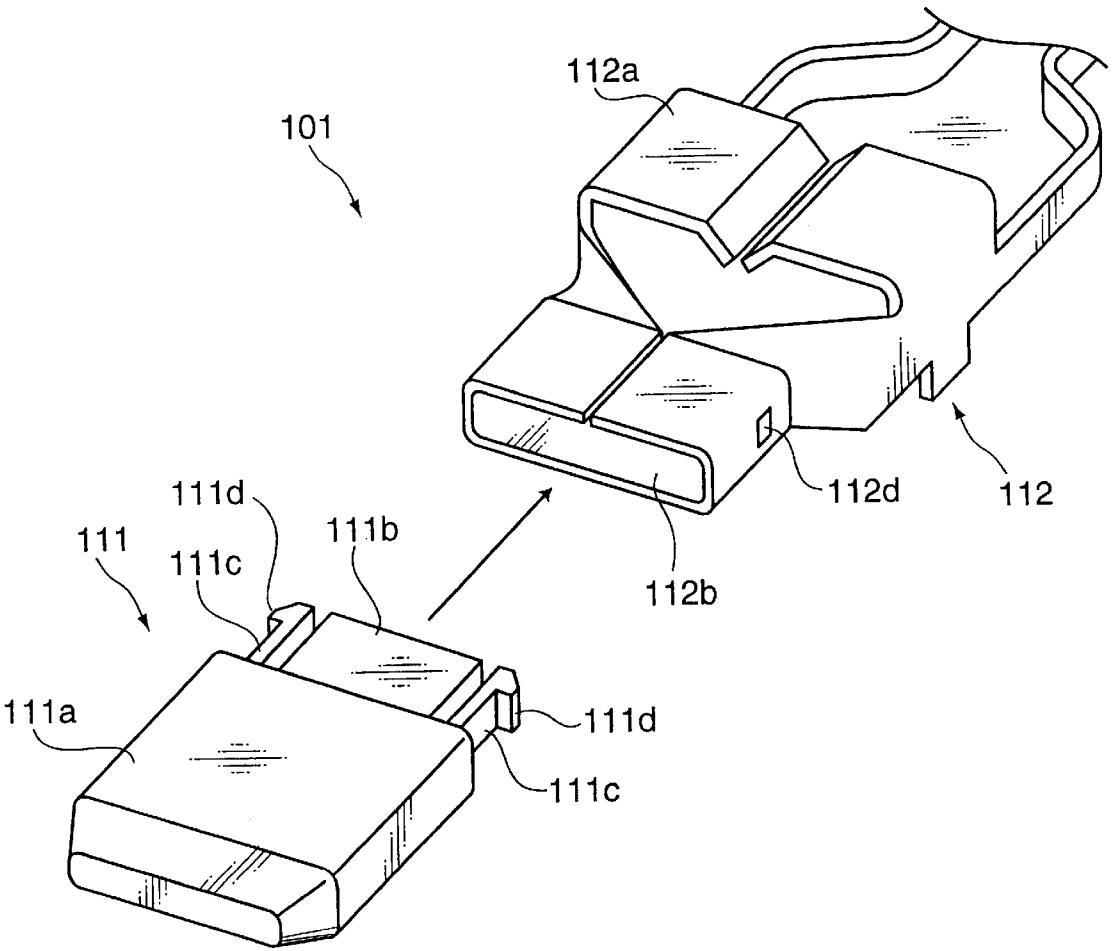
FIG. 5 is an exploded perspective view of a male terminal in accordance with a second embodiment of the invention in which a terminal main body and a terminal lead portion are independently manufactured.

In view of the above, it is preferable to construct a male terminal by two parts, as shown in FIG. 5, in such a manner that a terminal main body and a terminal lead portion which are independently provided are assembled together.

Now, a second embodiment of the invention is described with reference to FIGS. 5 to 7.

In FIG. 5, the male terminal 101 is constructed by the terminal main body 112 and the terminal lead portion 111. The terminal main body 112 is made of a single metallic plate similar to a known terminal except that an electric contact part 112*b* is formed at a frontal end thereof to be engaged with the terminal lead portion 111. The electric contact part 112*b* has a flat rectangular opening in cross section, and is formed with engaging holes 112*d* at respective opposite side portions thereof.

The terminal lead portion 111 includes a tab portion 111*a*which corresponds to the male tab 1*a* of the terminal 1 in the first embodiment. An engaging portion 111*b* projects rearwardly from an intermediate portion of a rear wall of the tab portion 111*a*. Engaging arms 111*c* extend rearwardly from side ends of the rear wall of the tab portion 111*a* in parallel with opposite side walls of the engaging portion 111*b*. A projection 111*d* is formed at an outer side of a rear end of the engaging arm 111*c* (111*c*). The engaging portion 11*b* and the engaging arm 111*c* each has such a thickness (height) to be fitted in the opening of the electric contact part 112*b*. Slidingly inserting the engaging portion 111*b* into the opening of the electric contact part 112*b* in a state that the projections 111*d* are engaged in the corresponding engaging holes 112*d* of the electric contact part 112*b*, as shown in FIG. 6, enables to engage the terminal lead portion 111 in a front portion of the terminal main body 112, whereby the male terminal 101 is assembled as a whole.

Figure 6:
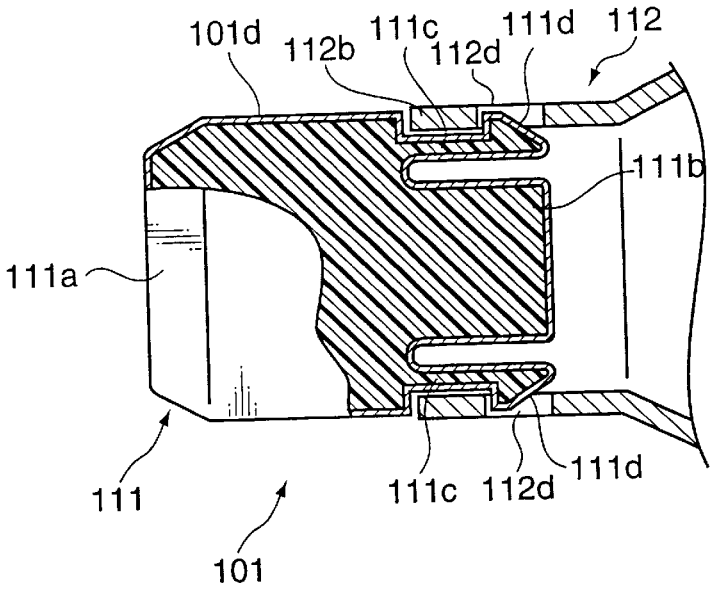
FIG. 6 is a sectional plan view partially showing an assembled state of the male terminal in FIG. 5.

As shown in FIG. 6, an electric conductive layer 110*d* is formed on a surface of a primary part of the terminal lead portion 111 composed of an insulating material. The terminal lead portion 111 is, for example, produced by integrally molding the primary part and by etching the surface thereof to form the conductive layer 101*d*. In this way, the terminal lead portion 111 is manufactured in a simplified manner without a masking process.

It is preferable to use the material having a high heat resistance for the primary part of the terminal lead portion 111, such as ceramic materials including alumina and aluminum nitride, thermosetting resins including epoxy resins and phenol resins, and thermoplastic resins including polyetheretherketone (PEEK) and polyphenylenesulfide (PPS). Metallic plating may include, similar to the first embodiment, electroless plating by copper and nickel, or combination of electroless plating with electrolytic plating or hot dipping with tin or the like. Alternatively, vapor deposition, coating with a conductive coating, adhesion of a metallic film or a conductive film, metallic coating, baking or its equivalent may be applicable in place of the metal plating.

The primary part of the terminal lead portion 111 is not necessary required to be a single molded member of an insulating material. As an altered form, an insulating layer may be provided by forming an oxide film on the surface of the primary part made of, e.g., aluminum or copper. Alternative means such as resin coating or enamel baking may be applicable. Molding the entirety of the primary part of the terminal lead portion 111 with an insulating material as mentioned above enables to provide the arc-discharge free terminal 101 without a possibility of breakage or damage of the insulating layer. This arrangement is advantageous in decreasing the number of processes to produce the terminal 101 because this arrangement eliminates necessity of forming an insulating layer independently.

The terminal according to the invention is not limited to the one having a tab-like configuration. A variety of modifications and alterations having different configurations and constructions are applicable. FIGS. 7 and 8 show a third embodiment of the invention in which a male terminal 201 and a female terminal 202 each has a cylindrical electric contact part.

Figure 7:
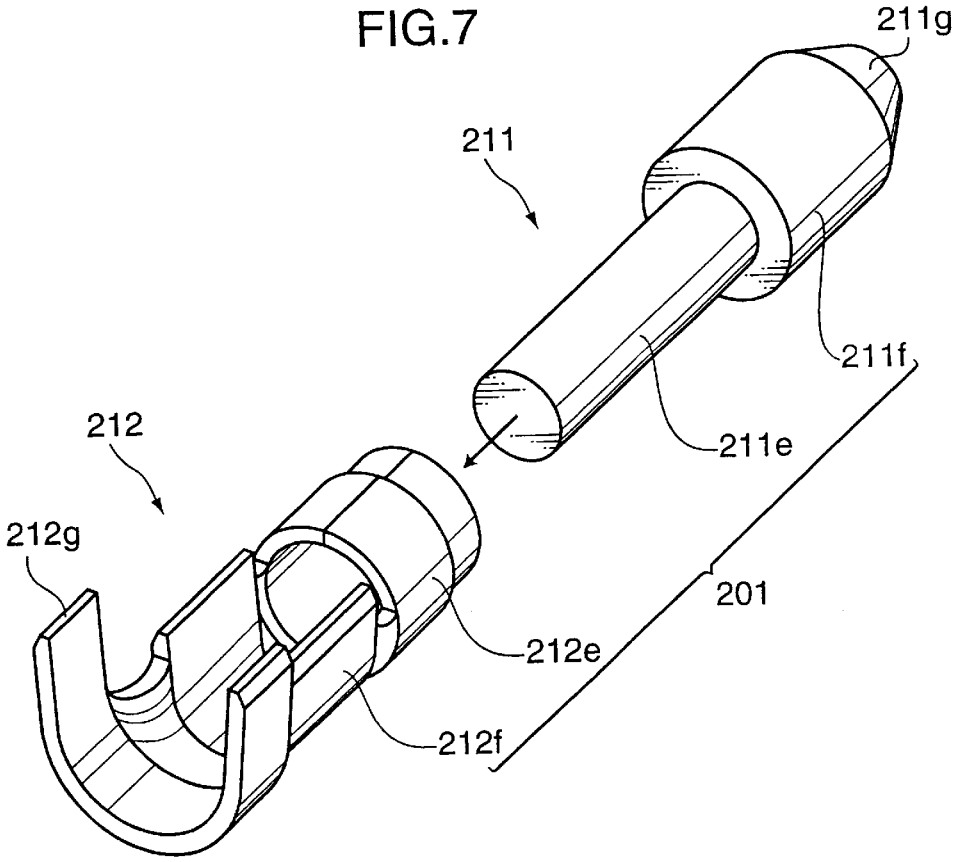
FIG. 7 is an exploded perspective view of a male terminal having a cylindrical electric contact part in accordance with a third embodiment of the invention.
Figure 8:
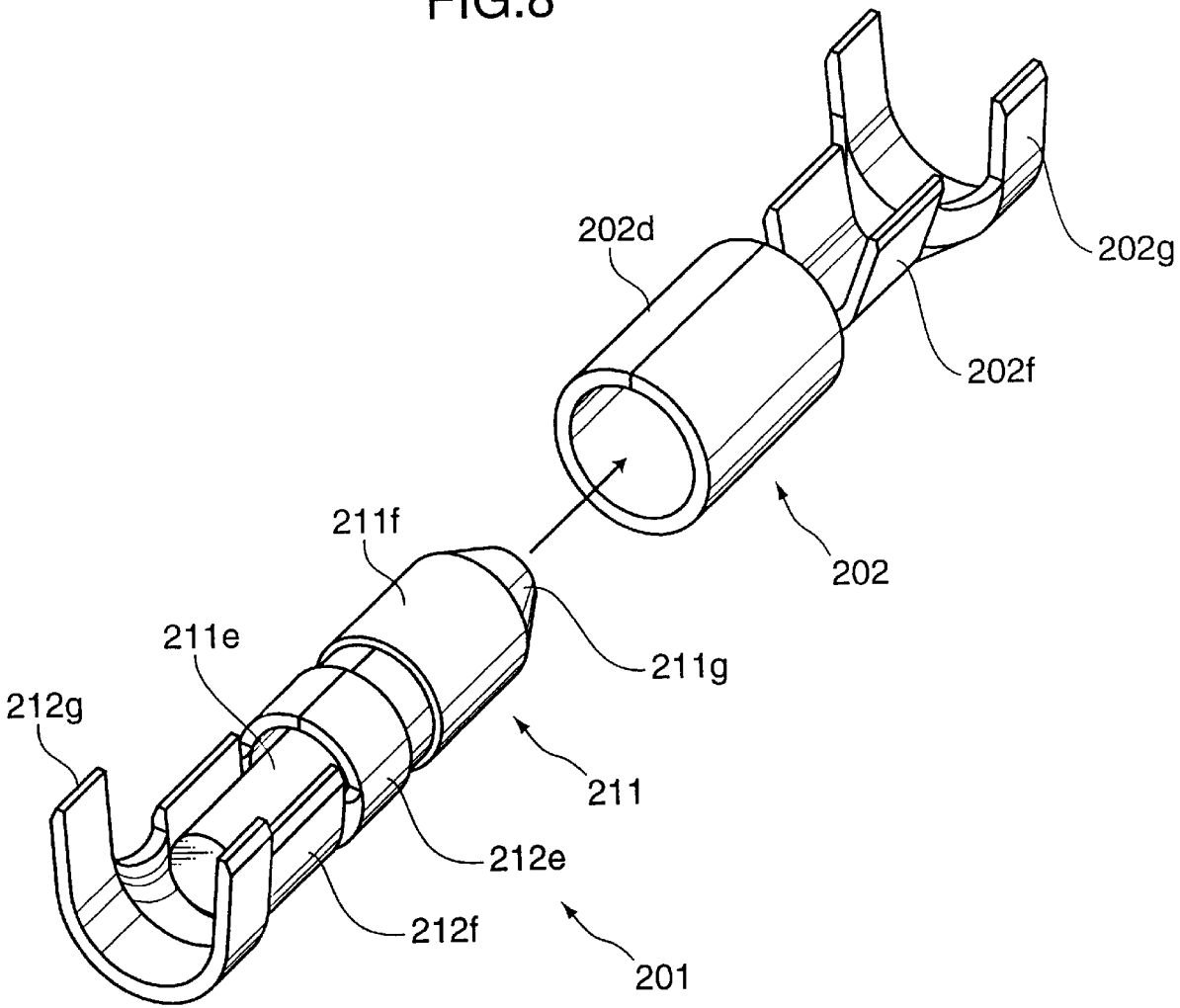
FIG. 8 is a perspective view showing a state that the male terminal in FIG. 7 is about to be engaged in a female terminal.

As shown in FIG. 7, the male terminal 201 is divided into a terminal lead portion 211 and a terminal main body 212.

The terminal lead portion 211 is constructed by integrally forming a cylindrical electric contact part 211*f* and a coupling shaft 211*e* which extends rearwardly from the electric contact part 211*f* and has a smaller diameter than that of the electric contact part 211*f*. A lead end 211*g* of the electric contact part 211*f* is tapered in the shape of a truncated cone.

The terminal main body 212 includes a cylindrical electric contact part 212*e* and a coupling shaft 212*f* in the form of a barrel and a wire casing 212*g* in the form of a barrel. The electric contact part 212*e* has such an inner diameter as to fittingly insert the coupling shaft 211*e*, and an outer diameter substantially equal to the outer diameter of the electric contact part 211*f*. Fittingly inserting the coupling shaft 211*e* axially into a hollow portion of the electric contact part 212*e* toward the wire casing 212*g* enables to integrally joint the terminal main body 212 with the terminal lead portion 211. In this state when a wire (not shown) is securely held in the wire casing 212*g*, the wire is electrically connectable to the male terminal 201.

As shown in FIG. 8, the female terminal 202 includes a cylindrical electric contact part 202*d* into which the electric contact parts 211*f*, 212*e* are fittingly inserted. A conductor casing 202*f* and an insulator casing 202*g* are provided in this order of the female terminal 202 at a downstream end in the terminal insertion direction shown by the arrow in FIG. 8.

Composing a surface region of at least a primary part of the terminal lead portion 211 of an insulating material and forming a conductive layer over the insulating region enables to provide the female terminal 202 with arc discharge suppression function in the similar manner as the male terminal 201. Specifically, when the electric contact parts 211*f*, 212*e* are about to be detached from the electric contact part 202*d*, the lead end 211*g* of the electric contact part 211*f* formed with a thin conductive layer corresponds to a final-contact part which is rendered in contact with the electric contact part 202*d* at a final stage of disengagement. Since the lead end 211*g* has a truncated conical shape, arc discharge which is liable to be generated at a time of disengagement is effectively suppressed, thereby protecting the male terminal 201 from breakage or damage due to arc discharge.

Figure 9:
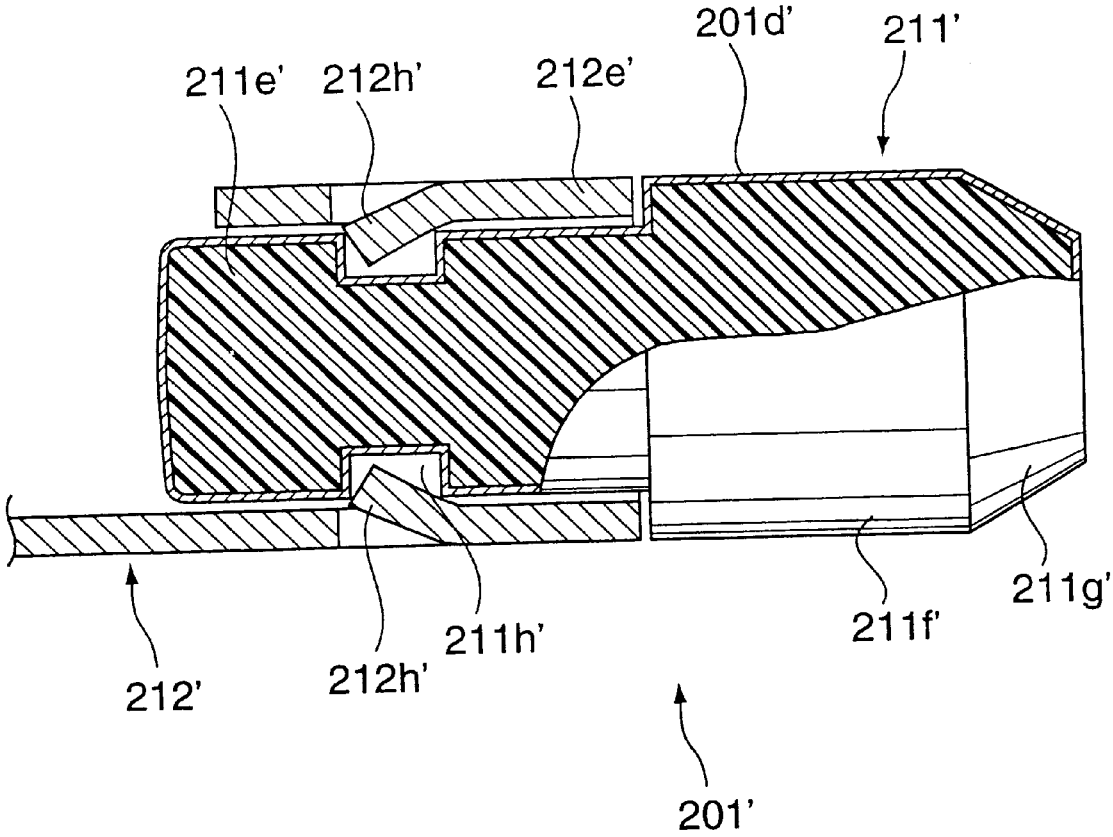
FIG. 9 is a sectional plan view partially showing a state that a terminal main body of an altered male terminal is engaged with a terminal lead portion thereof in the third embodiment.
Figure 10:
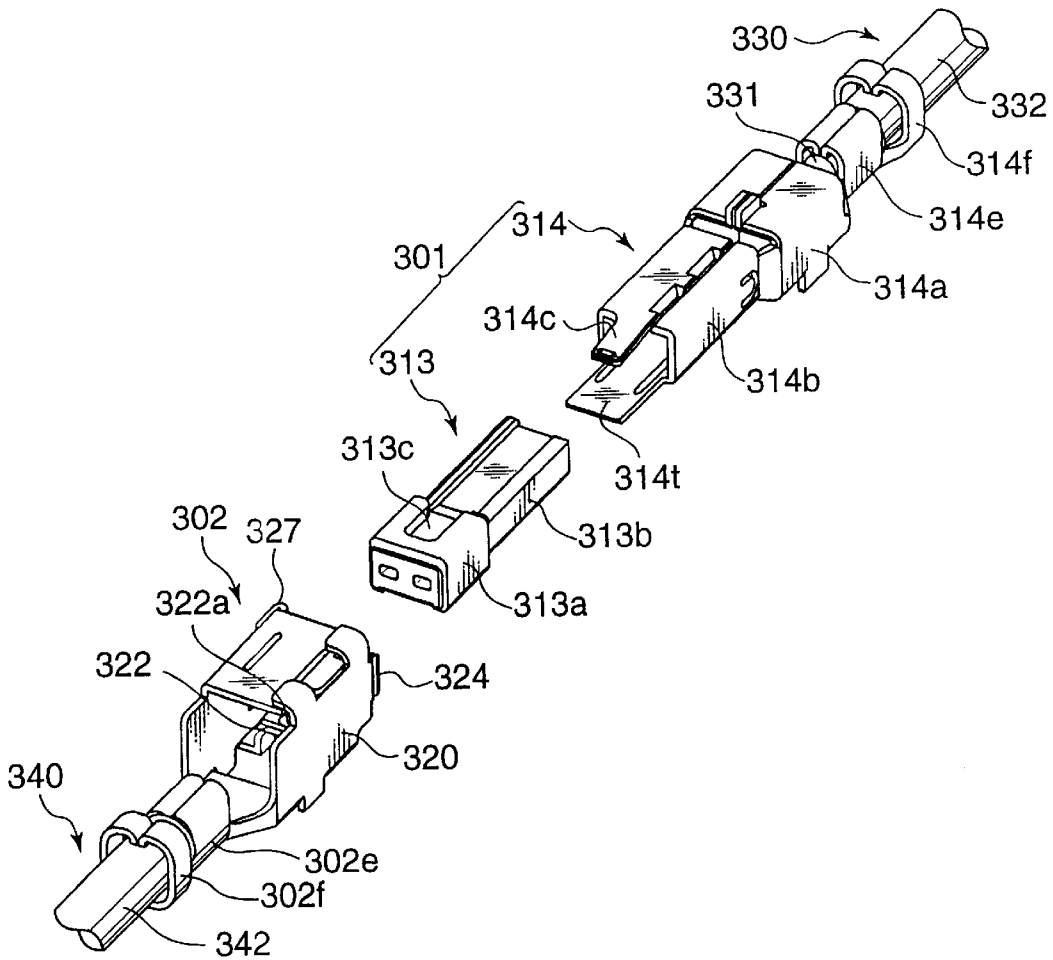
FIG. 10 is an exploded perspective view of a male terminal and a female terminal in accordance with a fourth embodiment of the invention in which the male terminal is comprised of a terminal main body and a terminal lead portion.
Figure 11:
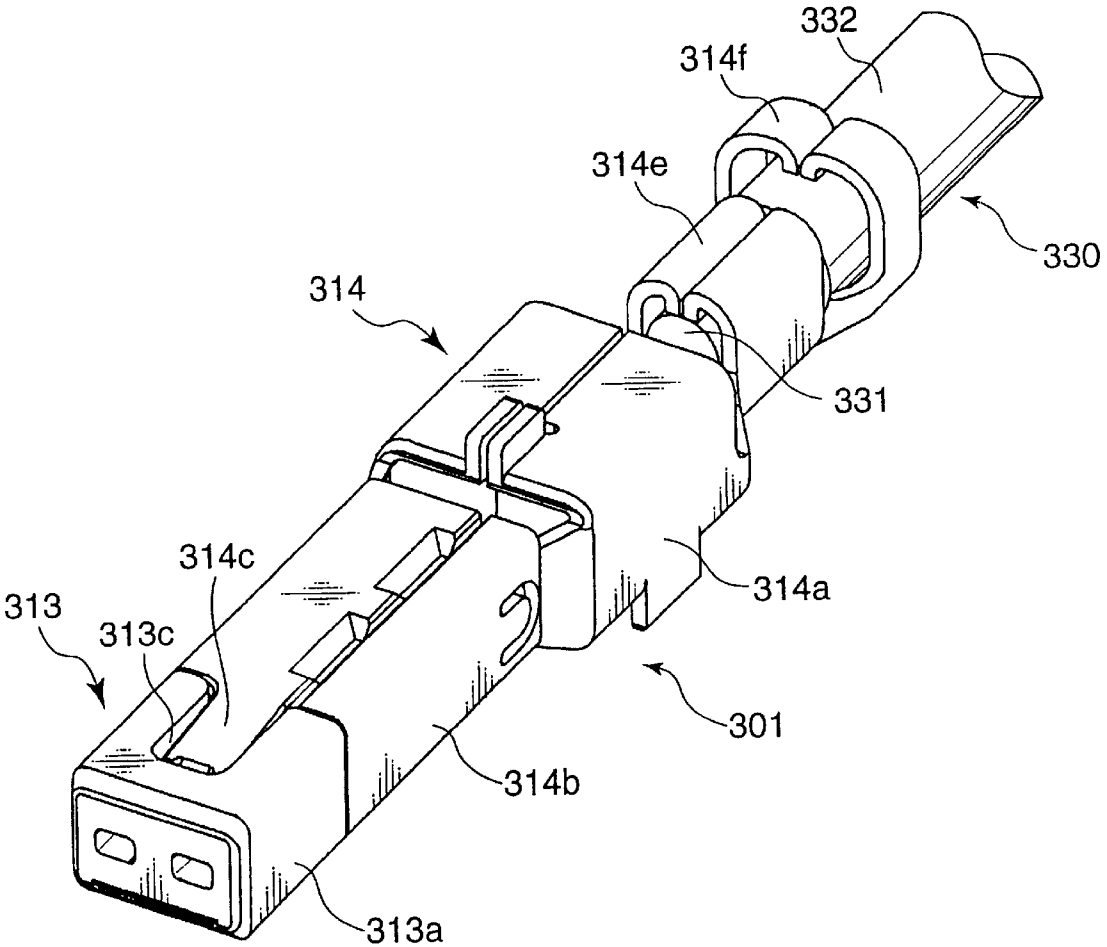
FIG. 11 is a perspective view showing a state that the terminal main body and the terminal lead portion of the male terminal shown in FIG. 10 are engaged.

The coupling construction of the terminal lead portion 211 and the terminal main body 212 is not limited to the one illustrated in FIG. 7. As an altered arrangement, as shown in FIG. 9, a recessed part 211*h* may be formed in an outer circumference of the coupling shaft 211*e* of the terminal lead portion 211, and an engaging piece 212*h* formed on the outer circumferential wall of the cylindrical electric contact part 212*e* of the terminal main body 212 may be pressingly inserted in the groove 211*h*.

A fourth embodiment of the invention is described with reference to FIGS. 10 through 20. The fourth embodiment is similar to the second embodiment and the third embodiment in that a male terminal 301 is divided into a terminal lead portion 313 and a terminal main body 314.

As shown in FIGS. 10 to 13, the male terminal 301 is constructed in such a manner that a primary part of a terminal lead portion 313 is integrally molded of an insulating material such as synthetic resin and a conductive layer 301*d* is formed on the insulating surface of the primary part by plating or its equivalent.

A head portion 313*a* having a generally rectangular parallelepiped shape and an engaging portion 313*b* extending rearwardly from the head portion 413*a* are integrally molded to form an entire configuration of the terminal lead portion 313. The sectional surface area of the engaging portion 313*b* is smaller than that of the head portion 313*a*. An axially extending recessed portion 313*c* is formed in a half rear portion on the top surface of the head portion 313*a* toward the engaging portion 313*b*.

The terminal main body 314 is constructed by bending a metallic plate having a high conductivity into a certain shape. A cylindrical (in FIG. 10, a generally prism-shaped) electric contact part 314*b* extends forwardly from a box-shaped main part 314*a*, and the engaging portion 313*b* of the terminal lead portion 313 is fixedly held in the electric contact part 314*b*. More specifically, a recessed portion 313*d* (see FIG. 12) is formed in a rear part on a bottom surface of the engaging portion 313*b*, and an upwardly and rearwardly projecting engaging piece 314*d* is formed at a rear part on a bottom wall of the electric contact part 314*b*. Fittingly inserting the engaging piece 314*d* in the recessed portion 313*d* enables to engage the terminal lead portion 314 with the terminal main body 313.

Figure 12:
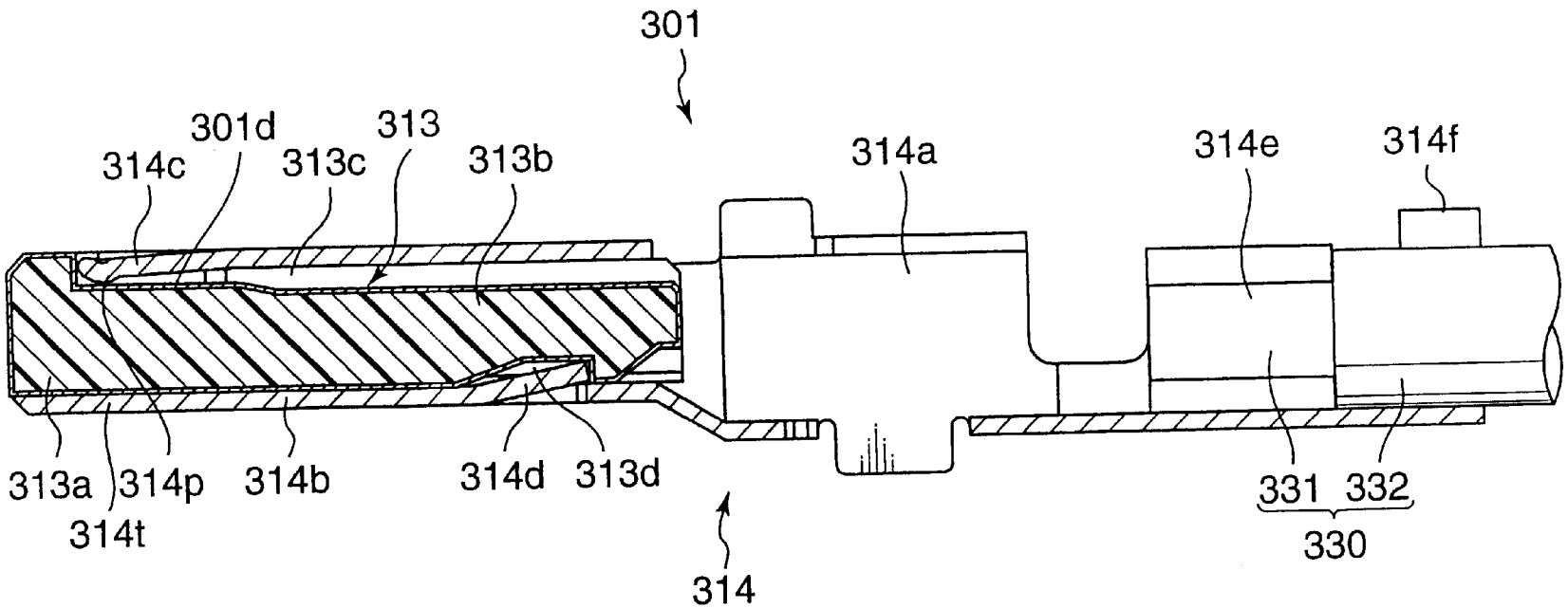
FIG. 12 is a sectional side view of the male terminal in FIG.
Figure 13:
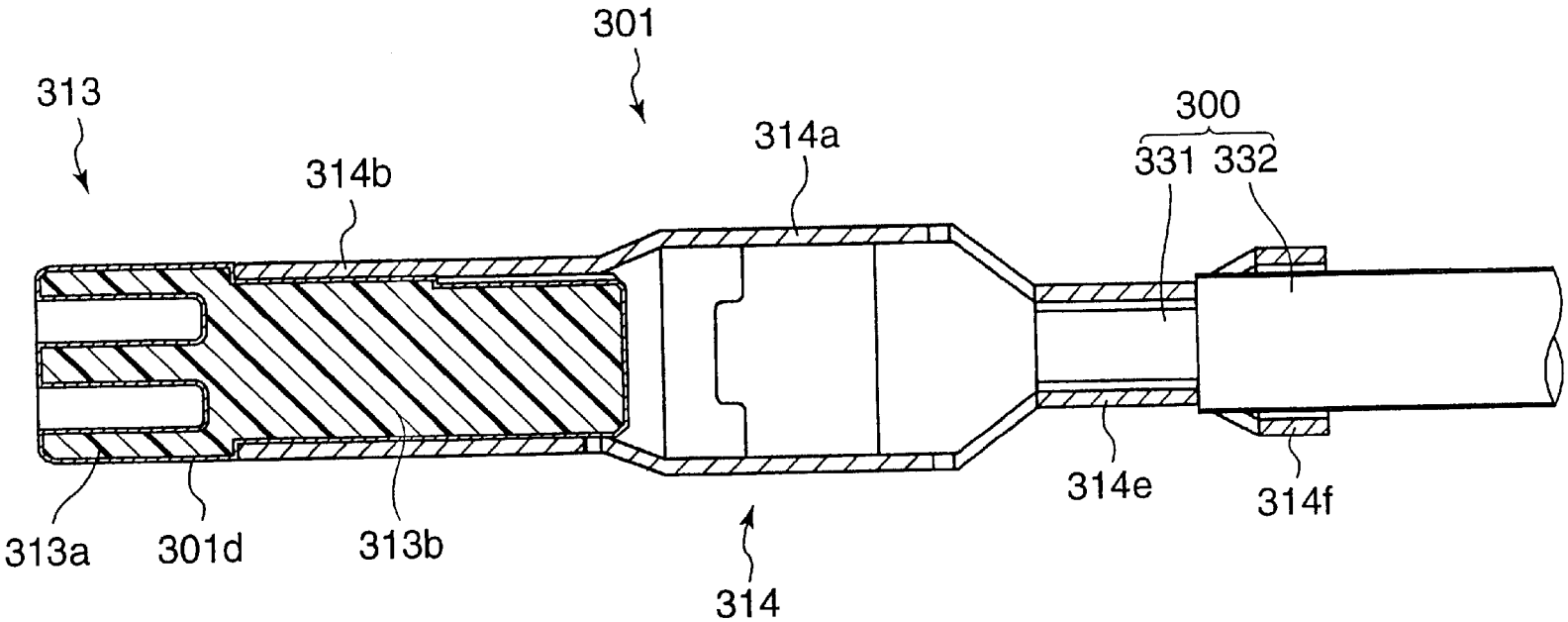
FIG. 13 is a sectional plan view of the male terminal in FIG. 11.

As shown in FIG. 12, a tongue-like piece 314*t* extends along the bottom wall of the electric contact part 314*b* to support the head portion 313*a* of the terminal lead portion 313 from below. A spring contact piece 314*c* extends forwardly from a top wall of the electric contact part 314*b*. A frontal end of the spring contact piece 314*c* is flexible (resiliently deformable), and a projection (contact) 314*p* projects downwardly from a lower surface of the lead end of the electric contact part 314*b*. When the engaging portion 313*b* of the terminal lead portion 313 is inserted in the electric contact part 314*b*, the spring contact piece 314*c* comes into sliding contact with the recessed portion 313*c* of the terminal lead portion 313, and the projection (contact) 314*p* formed at the lead end of the spring contact piece 314*c* is rendered into pressing contact with the conductive layer 301*d* formed on the lead part on the bottom surface of the recessed portion 313*c* in a state that the lead end of the spring contact piece 314*c* is upwardly deformed.

The terminal main body 314 is provided with a conductor casing 314*e* and an insulator casing 314*f* in this order rearwardly from the main part 314*a*. The conductor casing 314*e* has such a shape as to crimp a center conductor wire 331 (see FIG. 11) which is exposed from a lead end of an insulating wire 330. Thereby, the center conductor wire 331 and the terminal main body 314 are electrically connected. The insulator casing 314*f* has such a shape as to crimp an insulated part 332 of the insulating wire 330 at a rear position from the center conductor wire 331.

Figure 14:
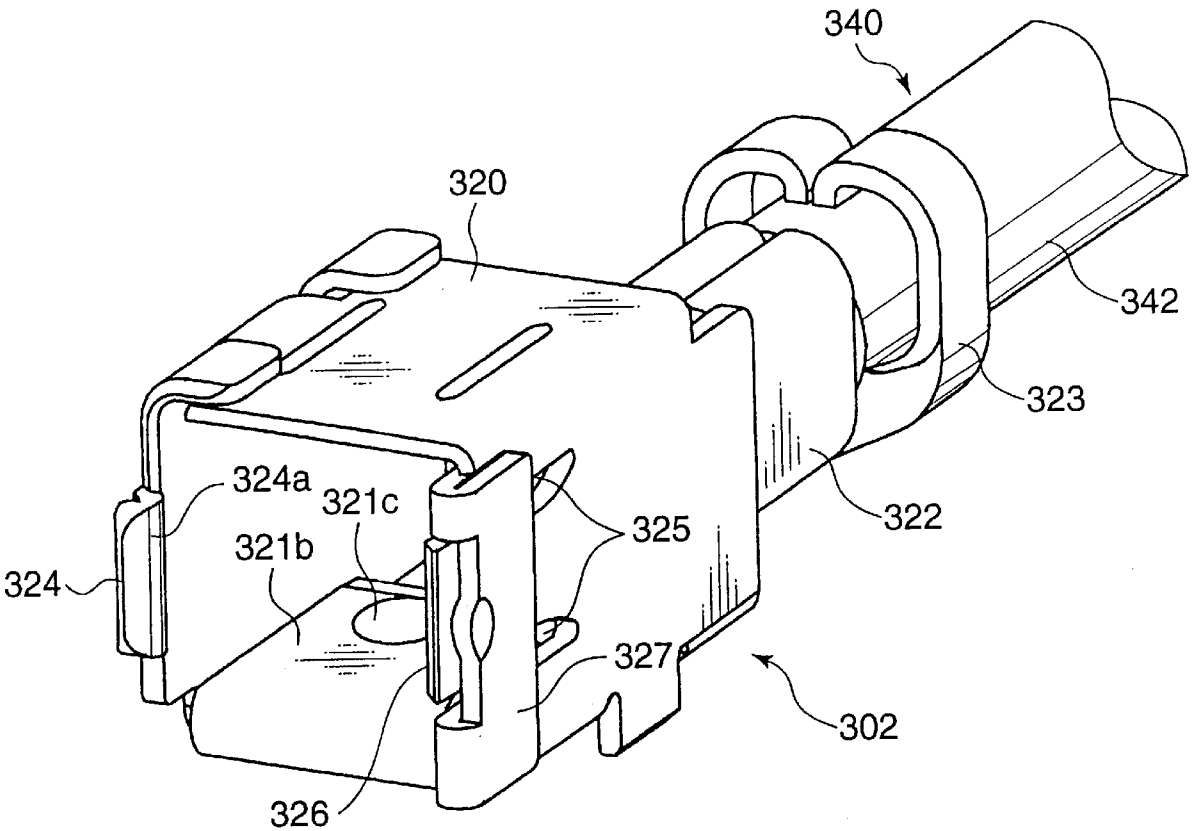
FIG. 14 is a perspective view of the female terminal in FIG. 10 viewed from forward direction.
Figure 15:
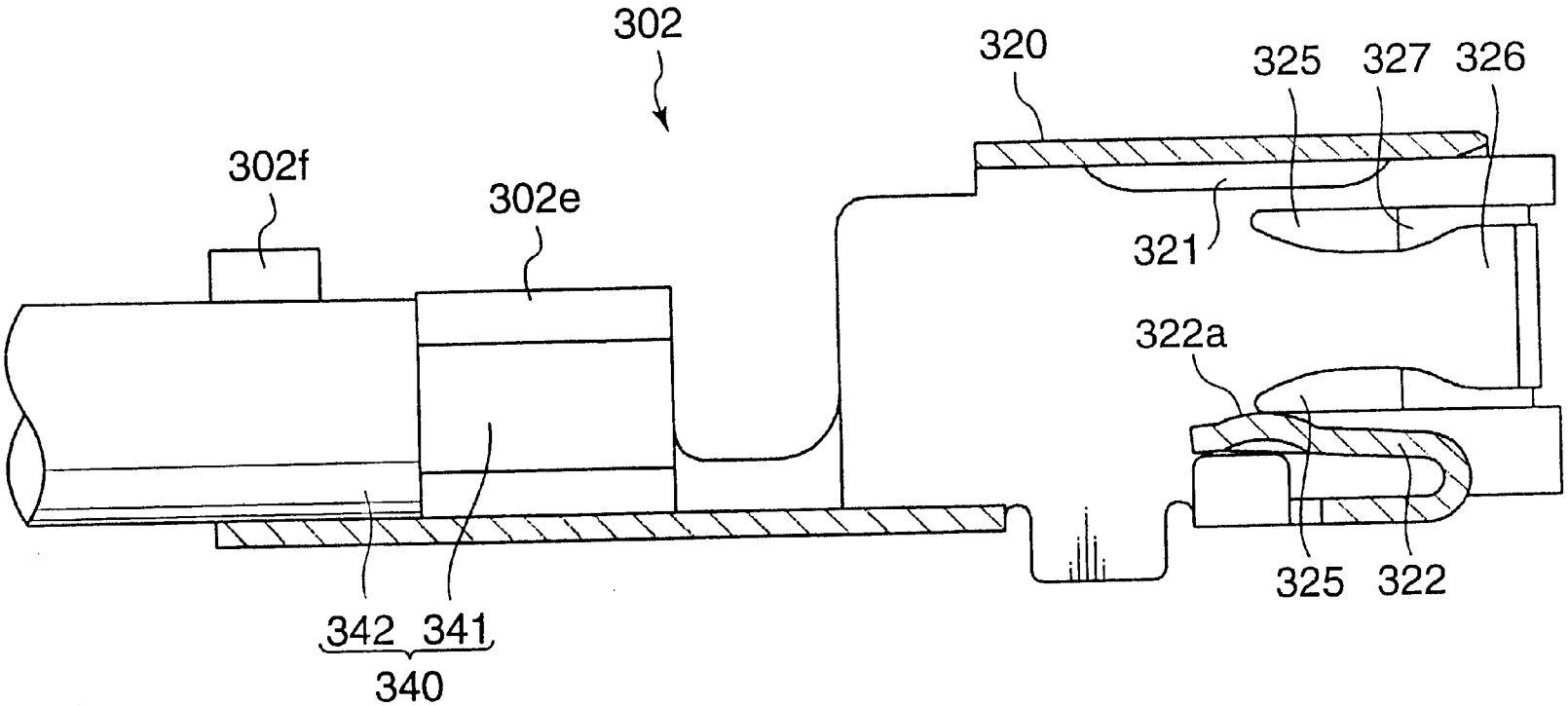
FIG. 15 is a sectional side view of the female terminal in FIG. 14.
Figure 16:
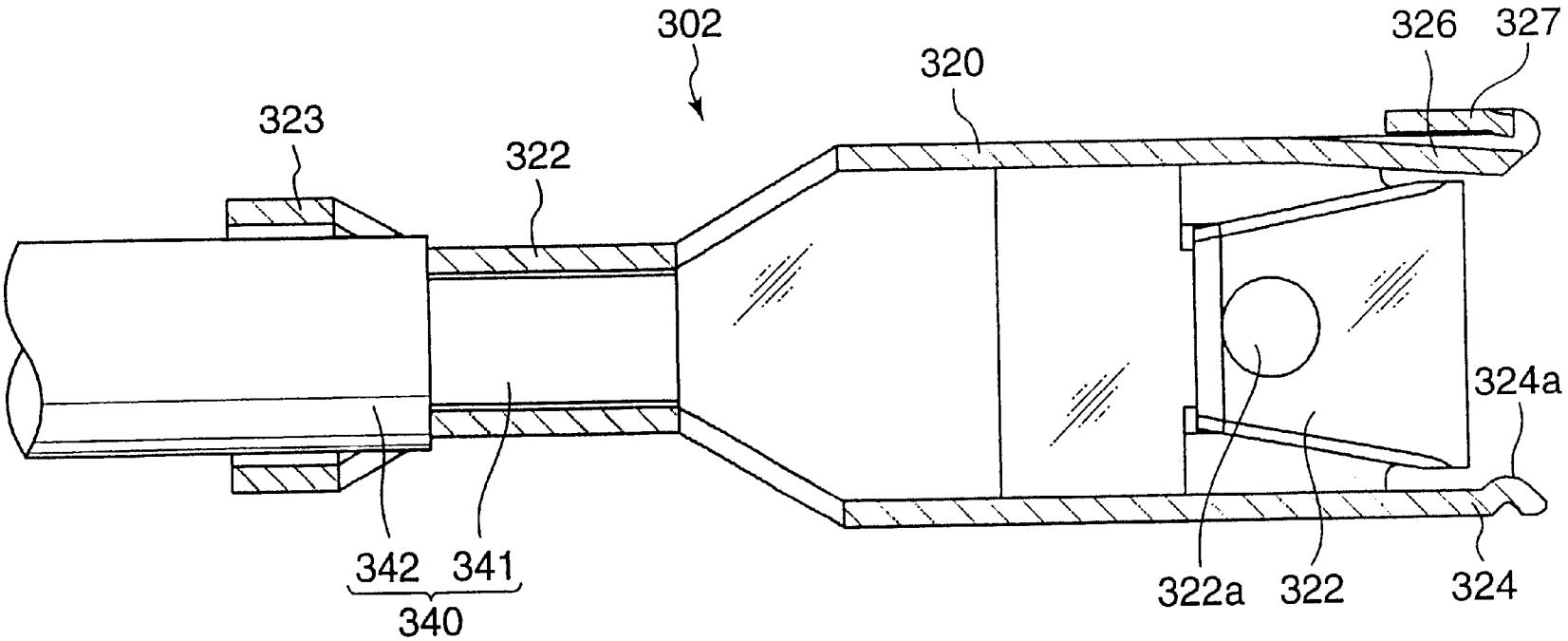
FIG. 16 is a sectional plan view of the female terminal in FIG. 14.

Next, the female terminal 302 which is engageable with the male terminal 301 is shown in FIGS. 14 through 16. The female terminal 302 is formed by bending a metallic plate having a high conductivity into a certain shape in the similar manner as the terminal main body 314 of the male terminal 301. The female terminal 302 is constructed in such a manner that a box-shaped electric contact part 320, a conductor casing 302*e*, and an insulator casing 302*f* which are formed rearwardly in this order from the electric contact part 320 are integrally formed. The conductor casing 302*e* and the insulator casing 302*f* have such a shape as to crimp a center conductor wire 341 and an insulating part 342 of an insulating wire 340, respectively.

The electric contact part 320 is formed with a projection 321 (see FIG. 15) axially extending on a lower surface of a top wall thereof. The projection 321 serves as an electric contact member against the male terminal 301. A substantially U-shaped spring contact piece 322 is formed on a lead end on the bottom wall of the electric contact part 320 with a free end directed rearwardly. A projection (contact) 322*a* is formed on the upper surface of a rear end portion (deformable free end portion) of the spring contact piece 322. The male terminal 302 is inserted in the electric contact part 320 in such a manner that the male terminal 301 is rendered into pressing contact with the projection 322*a* and the projection 321.

Further, the female terminal 302 has a feature that a fixed contact piece 324 and a spring contact piece 326 extend forwardly respectively from opposite side walls of the electric contact part 320 to constitute a contact portion for releasing generated arc.

The fixed contact piece 324 extends forwardly from the left side wall of the electric contact part 320, and is formed with an inward projection 324*a* at a front end thereof. A slit member 325 encloses an upper portion, a lower portion, and part of a front portion of the spring contact piece 326. A front end of the spring contact piece 326 is slightly tilted inwardly in such a manner that the front end is flexible sideways. The front half portion of the slit member 325 made of a metallic plate is bent rearwardly at about 180° and constitutes a protecting plate portion 327 to protect the spring contact piece 326 from an external force. The spring contact piece 326 and the fixed contact piece 324 securely nips the male terminal 301 inwardly in sideways directions.

Next, an operation of the male terminal and the female terminal as a pair in the fourth embodiment is described with reference to FIGS. 17 through 20.

Figure 17:
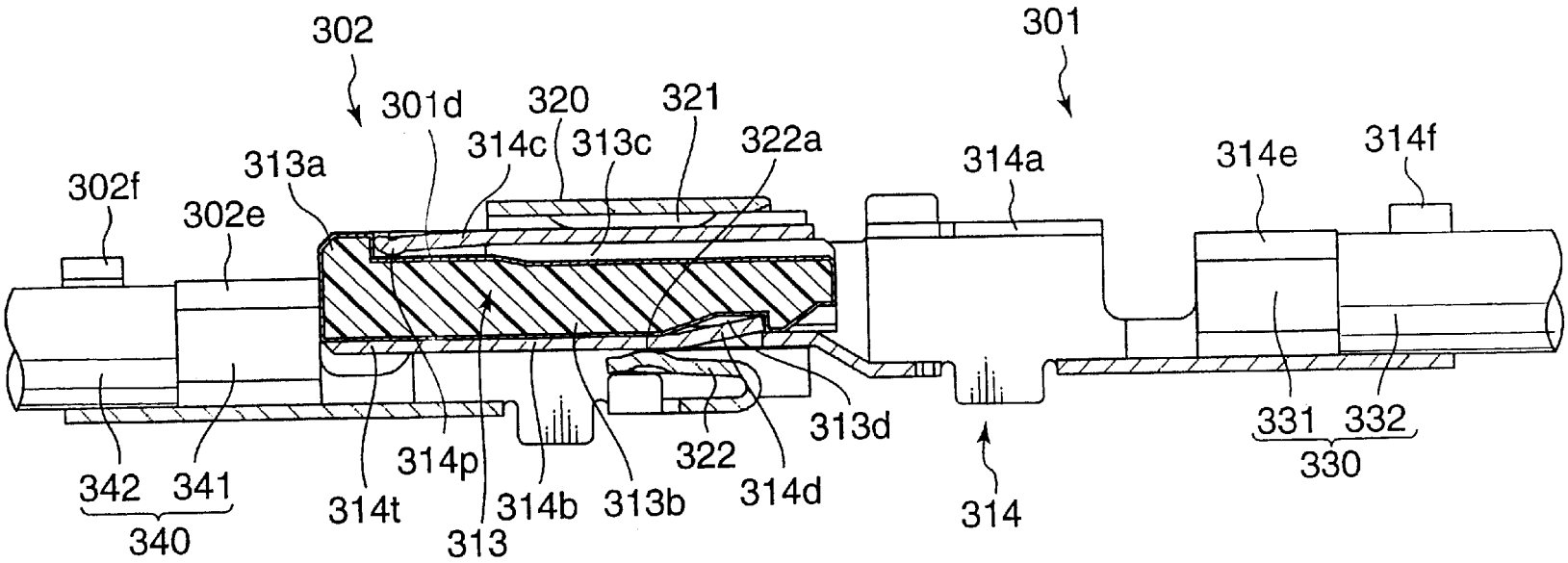
FIG. 17 is a sectional side view showing a state that the pair of male terminal and female terminal in FIG. 10 is in a completely engaged state.
Figure 18:
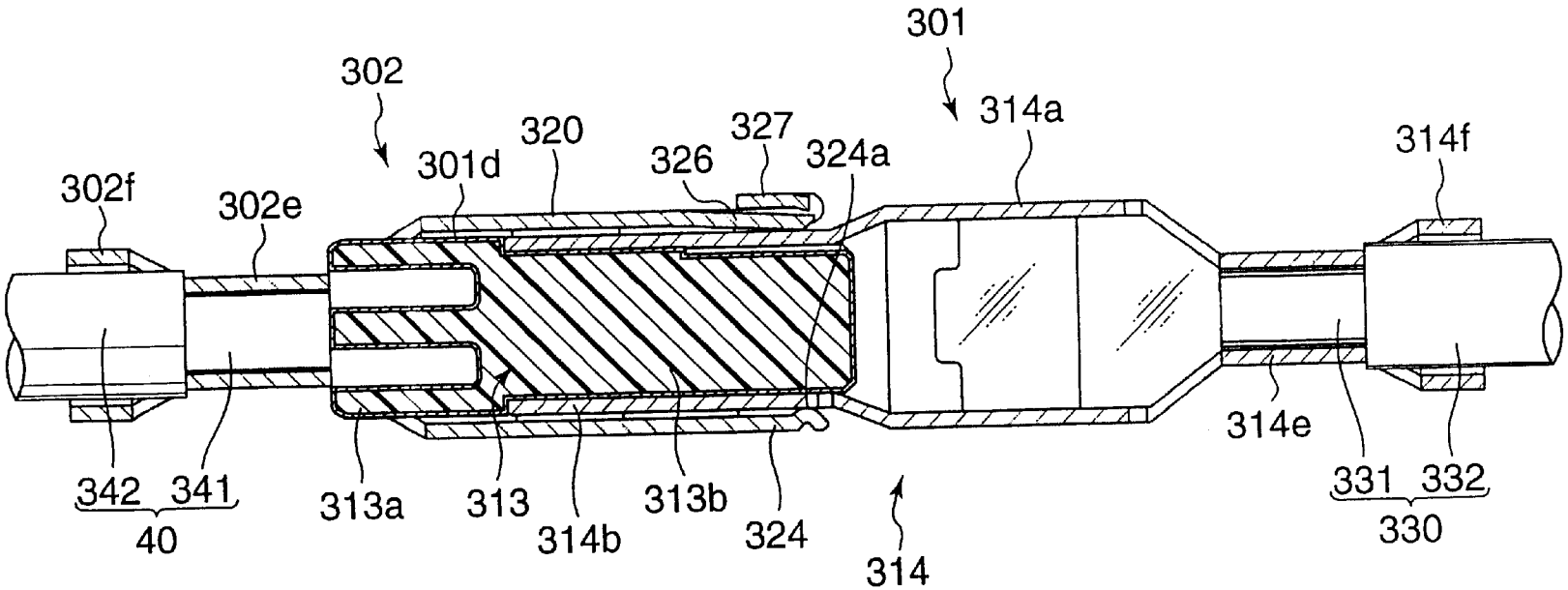
FIG. 18 is a sectional plan view showing a state that the terminal pair is in a completely engaged state.
Figure 19:
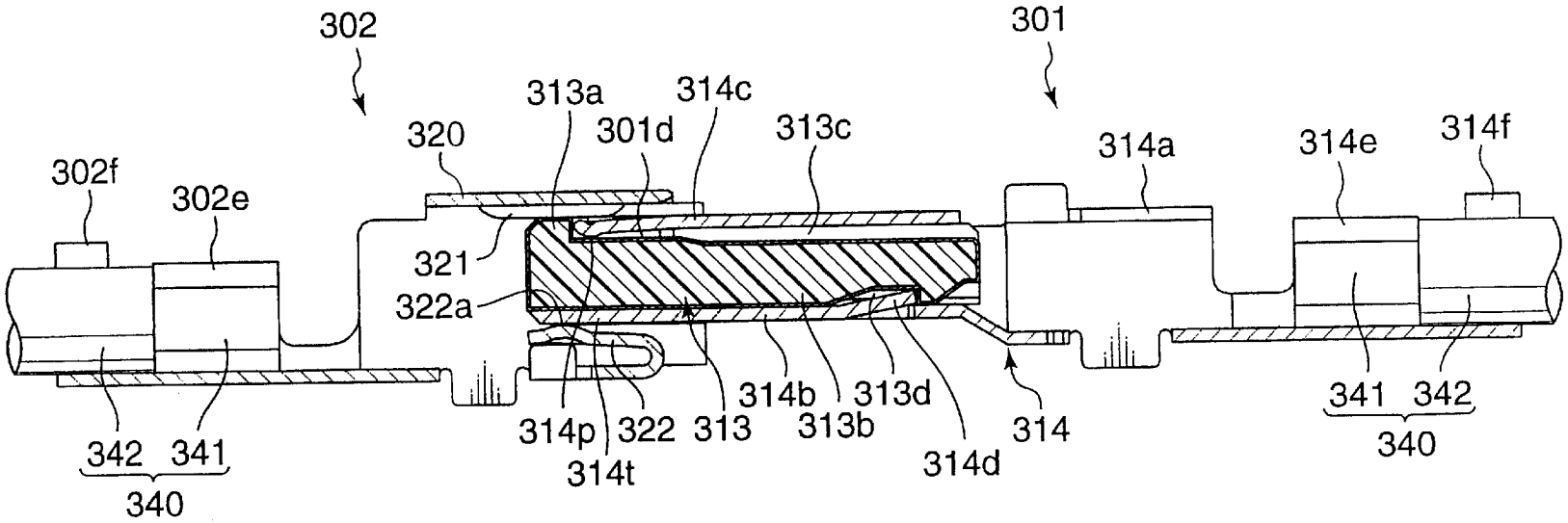
FIG. 19 is a sectional side view showing a state that the terminal pair is about to be disengaged.

As shown in FIGS. 17 and 18, the spring contact piece 322 of the electric contact part 320 of the female terminal 302 is deformable downwardly in a state that the male terminal 301 and the female terminal 302 are completely engaged. In this state, the projection 322*a* of the spring contact piece 322 and the projection 321 securely hold the electric contact part 314 of the male terminal 401 vertically. Specifically, the projection 322*a* and the projection 321 are rendered into pressing contact with the bottom wall and the top wall of the electric contact part 314, respectively due to a resilient force of the spring contact piece 322. Thus, the terminals 301 and 302 are electrically connectable via the pressing contact portion of the electric contact part 314.

The male terminal 301 is constructed in such a manner that the projection 314*p* of the spring contact piece 314*c* is rendered into pressing contact with the conductive layer 301*d* formed on the surface of the terminal lead portion 313 due to a resilient force of the spring contact piece 314*c* of the terminal main body 314 against the conductive layer 301*d*. Thus, the conductive layer 301*d* and the terminal main body 314 are electrically connectable by the pressing contact of the spring contact piece 314*c* against the conductive layer 301*d*. In the terminal main body 414 shown in FIGS. 17 and 18, the spring contact piece 414*c* which is designed to secure electric connection with the terminal lead portion 313, and the engaging portion (engaging piece 314*d*) which is designed to mechanically engage with the terminal lead portion 313 are formed independently. In this arrangement, since the contact spring piece 314*c* is free from a mechanical load, the electric connection of the male terminal and the female terminal can be secured while suppressing deformation of the contact spring piece 314*c*.

Next, when the terminals 301 and 302 are disengaged, first, contact of the projection 321 with the top wall of the electric contact part 314 is released (see FIG. 19), and then, contact of the tongue-like piece 314*t* of the electric contact part 314 with the projection 322*a* of the spring contact piece 322 is released. In this state, the fixed contact piece 324 and the spring contact piece 326 of the female terminal 302 are still rendered in contact state with the conductive layer 301*d* formed on the surface of the terminal lead portion 313*a*, and the electric connection of the conductive layer 301*d* with the terminal main body 314 is secured. Accordingly, there is no likelihood that arc is discharged at the time when the aforementioned members are released from the respective contact states.

Figure 20:
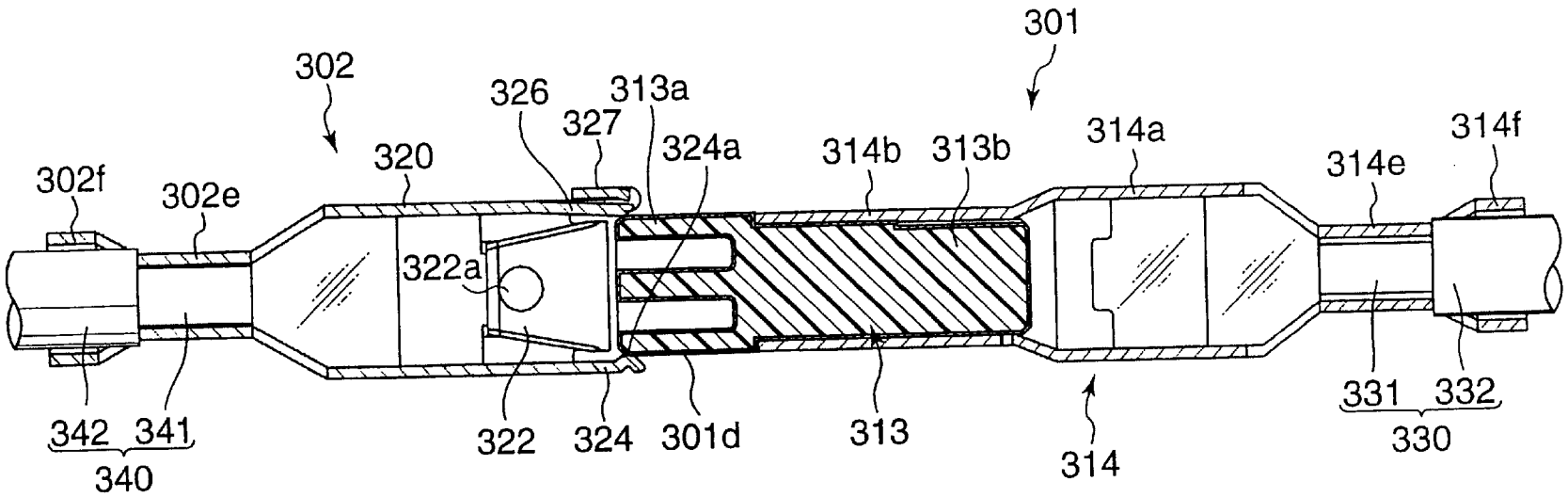
FIG. 20 is a sectional plan view showing a state immediately before the terminal pair is brought to a completely disengaged state.

There remains a likelihood that arc may be discharged when the fixed contact piece 324 or the contact spring piece 326 is detached from the conductive layer 301*d* (see FIG. 20). However, since the conductive layer 301*d* is an extremely thin film made of a plated metal or the like, arc discharge, even if occurs, is insignificant, and the terminals are effectively protected from damage due to arc discharge. Further, the terminal main body 314 is contacted with the conductive layer 301*d* at the projection 314*p* (contact site) which is formed at the frontal end of the spring contact piece 314*c*, and the spring contact piece 314*c* is connected to the terminal main body 314 via the rear end thereof. Since the distance between the contact site and a site (lead end) of the conductive layer 301*d* of the male terminal 301 which is detached from the female terminal 302 at a final stage of disengagement is short, an electric path of the conductive layer 301*d* along which current flows immediately before the male terminal 301 is disengaged from the female terminal 302 is short, thus effectively suppressing heated state of the terminals due to flow of current.

In the above arrangement, arc is discharged through a contact portion (in FIG. 14, the fixed contact piece 324 and the spring contact piece 326) which is provided independently of the electric contact portion (in FIG. 15, the projection 321 and the spring contact piece 322) of the female terminal 302. With this arrangement, the electric contact portion of the female terminal 302 is effectively protected from damage due to arc discharge, thereby securely providing electric connection with the male terminal 301.

Now, an example of producing the terminal shown in FIGS. 1 through 4 in accordance with the first embodiment of the invention is described. It should be appreciated that the invention is not limited to the below-mentioned example (s) and may be embodied in several forms without departing from the spirit of essential characteristics thereof since the scope of the invention is defined by the appended claims rather than by the description preceding them, and all changes that fall within metes and bounds of the claims, or equivalence of such metes and bounds are therefore intended to embraced by the claims.

EXAMPLE 1

A male terminal 1 and a female terminal 2 shown in FIGS. 1 to 4 were produced. An insulating layer (thickness=10 $\mu$m, electric resistance=$1\times10^{16}$ $\Omega$ or larger) was made from polyimide. An intermediate layer (not shown) was formed by subjecting a nickel plate to electroless plating. A conductive layer (thickness=10 $\mu$m) was formed by subjecting a tin plate to electrolytic plating.

The male terminal 1 and the female terminal 2 having the arrangement as shown in FIGS. 1 to 4 were connected, and then, the male terminal 1 was disconnected from the female terminal 2 in a state that a voltage of 42V was kept on being applied. Time duration of arc discharge occurrence was extremely short to such an extent that an accurate value was unmeasurable. It was verified, however, that the time duration of arc discharge occurrence was about 0.1 second. After the arc discharge, although the conductive layer of the lead end of the male terminal was slightly damaged, the external appearance of the male terminal remained unchanged.

COMPARATIVE EXAMPLE 1

This experiment was performed in the similar manner as Example 1 except that a conductive layer and an intermediate layer and an insulating layer were not formed.

Time duration of arc discharge occurrence was measured in the similar manner as Example 1. It was verified that time duration of arc discharge was about one second. After the arc discharge, the lead end of the male terminal was rounded.

Thus, it was verified that the invention is advantageous in effectively suppressing deformation and damage of terminals by suppressing arc discharge occurrence at a detachment of the terminals.

To sum up the invention, according to an aspect of the invention, an arc discharge suppressive terminal which is rendered into an electrically connectable state with a counterpart terminal by engaging with the counterpart terminal comprises an insulating section which is formed on at least an outer portion of the terminal including a region corresponding to a last contact part of the terminal which is rendered into contact with the counterpart terminal at a final stage of disengagement of the terminals; and a conductive layer which is formed on an upper surface of the insulating member to be electrically connectable to a main body of the terminal. The conductive layer is formed at such a location as to be detached from the counterpart terminal at the final stage of disengagement.

The arc discharge suppressive terminal may be formed of an integral member. Preferably, the terminal may be a two-piece member constructed in such a manner that a terminal lead portion is jointed to a terminal main body made of a conductive member at a front end of the terminal main body. In this case, preferably, the terminal lead portion may include a primary part with at least a surface thereof made of an insulating material, and a conductive layer may be formed on the surface of the primary part to be electrically connected to the terminal main body.

In this arrangement, since the terminal is constructed by the terminal main body made of a conductive member and the terminal lead portion including an insulating member, parts for constituting the terminal (particularly, terminal main body) can be mass-produced, and production thereof is facilitated.

In the above arrangement, it is possible to mold the entirety of the primary part of the terminal lead portion with an insulating material. This arrangement is advantageous in that durability of the insulating portion is improved compared to a case where a thin insulating film is formed on the surface of the primary part, thereby securely maintaining arc suppressing function due to the existence of the insulating portion.

According to another aspect of the invention in light of connection between the conductive layer of the terminal lead portion and the terminal main body, it may be preferable that a resiliently deformable spring contact portion is formed on the terminal main body in such a manner as to be rendered into pressing contact with the conductive layer of the terminal lead portion in a resiliently deformed state.

In this arrangement, the spring contact portion can be securely contacted to the conductive layer of the terminal lead portion by utilizing a biasing force due to resilient deformation of the spring contact portion. Thus, the connection of the conductive layer of the terminal lead portion and the terminal main body can be secured.

The thinner the conductive layer is, the higher the electric resistance is. Therefore, if a distance between a contact position of the spring contact portion with the conductive layer and a position at which the conductive layer is detached from the counterpart terminal at a final stage of disengagement is long, there is a likelihood that current flows in the conductive layer between these positions which may result in heated state of the terminals. In view of this, it is preferable to configure the terminal in such a manner that the spring contact portion has a rear end thereof connected to the terminal main body and a front end thereof which is made into a resiliently deformable free end, and the front end is rendered into contact with the conductive layer of the terminal lead portion in a state that the front end is resiliently deformed.

In this arrangement, the contact position of the spring contact portion with the conductive layer of the terminal lead portion can be closer to a position (generally, a lead most end position) where arc discharge is likely to generate on the conductive layer. Thus, heated state of the conductive layer between the aforementioned positions can be effectively suppressed.

According to yet another aspect of the invention, it may be preferable to construct the terminal in such a manner that the terminal main body is formed with an engaging portion engageable with the terminal lead portion and the spring contact portion is formed at a position independently of the engaging portion. Thus, a mechanical connecting site (engaging portion) for mechanically connecting the terminal main body to the terminal lead portion and an electrical connecting site (spring contact portion) are independently provided. With this arrangement, the terminal main body and the terminal lead portion can be securely connected while reducing a mechanical burden at the spring contact portion and suppressing deformation thereat.

According to still another aspect of the invention, an arc discharge suppressive terminal which is rendered into an electrically connectable state with a counterpart terminal by engaging with the counterpart terminal comprises: an insulating layer which is formed on a region corresponding to a last contact part of the terminal which is rendered into contact with the counterpart terminal at a final stage of disengagement of the terminals; and a conductive layer which is formed on the insulating layer to be electrically connectable to the counterpart terminal.

Preferably, in the above arrangement, at least part of a contact portion of the terminal in contact with the counterpart terminal in an engagement with the counterpart terminal may include a non-formation area of the insulating layer to render the terminal into direct contact with the counterpart terminal or indirect contact with the counterpart terminal via the conductive layer.

Preferably, in the above arrangement, the conductive layer may be made of a thin film.

According to a further aspect of the invention, a pair of terminals include an arc discharge suppressive male terminal and a female terminal engageable with the male terminal. The terminal pair is constructed in such a manner that an electric contact part of the female terminal is rendered into contact with a conductive layer non-formation area on the main body of the male terminal in a state that the male terminal and the female terminal are in a completely engaged state.

In this arrangement, electric connection between the terminals in an engaged state is performed by direct contact of the terminal main body of the male terminal with the female terminal (in the case where the entirety of the male terminal is formed of a conductive material) not through the conductive layer. This arrangement is advantageous in securely performing electric connection compared to a case where the female terminal is contacted merely with the conductive layer.

In the above arrangement, it is preferable that the female terminal may be provided with a contact portion which is rendered into contact with the male terminal at a forward position from the electric contact part in a terminal disengaging direction, and the contact portion is provided at such a position that the contact portion is detached from the conductive layer of the male terminal after the electric contact part is detached therefrom when the male terminal is disengaged from the female terminal to suppress arc discharge.

In the above arrangement, since the contact portion at which arc discharge may generate and the electric contact part are provided independently, life of the terminal pair can be extended while effectively protecting the electric contact part. This arrangement provides secured electric connection between the terminals.

More specifically, it is preferable that a spring contact piece is formed at a front end of the female terminal, the spring contact piece has a front end resiliently deformable, and the front end of the spring contact piece is so configured as to be rendered into contact with the conductive layer of the male terminal in a state that the front end of the spring contact piece is resiliently deformed.

In this arrangement, arc discharge can be performed at a position forwardly away from the female terminal main body. This arrangement is advantageous in that the female terminal can be securely protected and that the contact between the spring contact piece and the conductive layer can be secured by utilizing a resilient force due to resilient deformation of the spring contact piece for arc discharge.

According to yet another aspect of the invention, a connector comprises the arc discharge suppressive terminal as mentioned above and a housing for accommodating the terminal therein.

According to still another aspect of the invention, a method for manufacturing an arc discharge suppressive terminal which is rendered into an electrically connectable state by engaging with a counterpart terminal comprises the steps of: producing a terminal main body made of a conductive material; producing a terminal lead portion including a primary part with at least a surface thereof made of an insulating material and a conductive layer which is formed on the surface of the primary part; and jointing the terminal lead portion to the terminal main body at a front end of the terminal main body in such a manner that the conductive layer is detached from the counterpart terminal at a final stage of disengagement of the terminal from the counterpart terminal.

In the above method, the terminal main body made of a conductive material and the terminal lead portion including an insulating material are independently produced, and then, the terminal main body and the terminal lead portion are jointed together to assemble the entirety of the terminal. This arrangement enables to mass-produce respective parts with ease. Accordingly, compared to a method in which an insulating layer and a conductive layer are provided on a predetermined region on a lead portion of a terminal which is integrally molded, the production process is simplified and productivity can be remarkably improved.

In the case where a conductive film is formed by etching the surface of an insulating section, it is highly likely that the terminal main body which is not provided with the insulating section may be corroded by the etching process if the entirety of the terminal is integrally molded. In view of this, in the above method, preferably, the step of producing the terminal lead portion includes a step of producing the primary part of the terminal lead portion, and a step of etching the surface of the primary part to form a conductive film. Then, the thus constructed terminal lead portion is jointed to the terminal main body. This arrangement facilitates the etching process which is required for forming a conductive film without affecting the terminal main body.

Preferably, the primary part of the terminal lead portion is integrally molded by an insulating material. This arrangement eliminates an additional step of forming an insulating layer, which further simplifies the production process.

This application is based on patent application Nos. 2000-361799, 2001-225614 and 2001-310027 filed in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A terminal which is to be brought into engagement with a counterpart terminal to be electrically connected with the counterpart terminal, the terminal comprising:

a main body composed of electrically conductive material;

a lead portion provided at a front side of the main body and including a regions which is in contact with the counterpart terminal at a final stage while the terminal is being disengaged from the counterpart terminal, the lead portion being composed of insulating material at least on its surface; and an electrically conductive layer formed on an insulating portion of the lead portion and extended rearward beyond the insulating portion to be formed directly on the main body to be electrically connected with the main body.

2. The terminal according to claim 1, wherein the main body and the lead portion rare integrally formed and an insulating layer is formed on an outer surface of the lead portion, with the electrically conductive layer being formed on the insulating layer and extending further to be formed on a portion of the main body to be electrically connected therewith.

3. A male terminal which is to be brought into engagement with a counterpart female terminal to be electrically connected therewith, the male terminal comprising:

a main body made of electrically conductive material;

a lead portion made of an insulating material at least over its outer surface, wherein the lead portion is coupled with the main body to form a front part of the male terminal and includes a region which is in contact with the counterpart female terminal at a final stage while the male terminal is being disengaged from the counterpart female terminal; and an electrically conductive layer formed on the insulating material of the lead portion, and electrically connected with the main body;

wherein the lead portion is molded of the insulating material and the electrically conductive layer is formed thereon.

4. A male terminal which is to be brought into engagement with a counterpart female terminal to be electrically connected therewith, the male terminal comprising:

a main body made of electrically conductive material;

a lead portion made of an insulating material at least over its outer surface, wherein the lead portion is coupled with the main body to form a front part of the male terminal and includes a region which is in contact with the counterpart female terminal at a final stage while the male terminal is being disengaged from the counterpart female terminal; and an electrically conductive layer formed on the insulating material of the lead portion, and electrically connected with the main body;

wherein a resiliently deformable spring contact portion is formed on the main body in such a manner as to be rendered into pressing contact with the electrically conductive layer of the lead portion in a resiliently deformed state when the main body is coupled with the lead portion.

5. The male terminal according to claim 4, wherein the spring contact portion includes a rear end to be electrically connected with the main body and a front end having a form of a resiliently deformable free end, the front end being brought into contact with the electrically conductive layer of the lead portion with the front end being resiliently deformed.

6. The male terminal according to claim 4, wherein the main body is formed with an engaging portion engageable with the lead portion for retaining the lead portion in a condition coupled with the main body, with the engaging portion being formed independently of the spring contact portion.

7. A terminal which is to be brought into engagement with a counterpart terminal to be electrically connected with the counterpart terminal, the terminal comprising:

a main body composed of electrically conductive material;

an insulating layer formed on a front portion of the main body in an area including a region which is in contact with the counterpart terminal at a final stage while the terminal is being disengaged from the counterpart terminal; and a conductive layer formed on the insulating layer and extended rearward beyond the insulating layer to be formed directly on the main body to be electrically connected therewith.

8. The terminal according to claim 7, wherein the insulating layer is formed such that a portion of the main body not covered by the insulating layer is engaged by the counterpart terminal upon completion of connection of the terminal with the counterpart terminal.

9. The terminal according to claim 7, wherein the terminal is a male terminal which is to be brought into engagement with a counterpart female terminal to be electrically connected therewith, the insulating layer is formed on a lead portion of the male terminal from its distal end to a rear of the terminal leaving an area not covered by the insulating layer.

10. The terminal according to claim 7, wherein the conductive layer is made of a thin film.

11. In a connector assembly including a male terminal and a female terminal to be coupled with each other for electrical connection therebetween, the male terminal comprising:

a main body made of electrically conductive material;

an insulating layer formed on a front portion of the main body in an area including a region which is in contact with the female terminal at a final stage while the male terminal is being disengaged from the female terminal; and an electrically conductive layer formed on the insulating layer of the front portion, and extended beyond the insulating layer to be formed directly on the main body, leaving a bare area of the main body where the main body is exposed, the bare area being formed at an area to be engaged by said female terminal upon completion of a coupling of the male and female terminal.

12. The connector assembly according to claim 11, wherein the female terminal is provided with a low-arc contact portion formed at a location to be in contact with a fore portion of the male terminal such that the low-arc contact portion disengages from the male terminal at a later stage while the male terminal is being disengaged from the female terminal.

13. The connector assembly according to claim 12, wherein the female terminal includes a resiliently deformable spring connect which is to be in contact with the electrically conductive layer of the male terminal with the spring contact being in a deformed state.

14. The connector assembly according to claim 12, further comprising a housing for accommodating the male and female terminals.

15. A method for manufacturing a terminal which is to be brought into engagement with a counterpart terminal to be electrically connected therewith, the method comprising the steps of:

preparing a main body of electrically conductive material;

preparing a lead portion having a primary part, making insulating at least a surface of the primary part;

forming an electrically conductive layer over the primary part; and coupling the lead portion to a front end of the main body;

wherein the step of forming an electrically conductive layer includes sub-steps of:

etching the surface of the primary part; and plating the etched surface to form the electrically conductive layer thereon.

16. A method for manufacturing a terminal which is to be brought into engagement with a counterpart terminal to be electrically connected therewith, the method comprising the steps of:

preparing a main body of electrically conductive material;

preparing a lead portion having a primary part, making insulating at least a surface of the primary part;

forming an electrically conductive layer over the primary part; and coupling the lead portion to a front end of the main body;

wherein the step of preparing the lead portion includes a sub-step of integrally molding the lead portion out of an insulating material.

* * * * *